US008648241B2

(12) United States Patent
Okuda

(10) Patent No.: US 8,648,241 B2
(45) Date of Patent: Feb. 11, 2014

(54) KEY DETERMINATION APPARATUS AND STORAGE MEDIUM STORING KEY DETERMINATION PROGRAM

(75) Inventor: Hiroko Okuda, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 198 days.

(21) Appl. No.: 13/245,230

(22) Filed: Sep. 26, 2011

(65) Prior Publication Data

US 2012/0073423 A1 Mar. 29, 2012

(30) Foreign Application Priority Data

Sep. 27, 2010 (JP) ..... 2010-214648

(51) Int. Cl.
*A63H 5/00* (2006.01)

(52) U.S. Cl.
USPC ..... 84/609

(58) Field of Classification Search
USPC ..... 84/609
See application file for complete search history.

(56) References Cited

U.S. PATENT DOCUMENTS

| | | | | |
|---|---|---|---|---|
| 5,296,644 | A | 3/1994 | Aoki | |
| 5,302,777 | A | 4/1994 | Okuda et al. | |
| 5,412,156 | A | 5/1995 | Ikeda et al. | |
| 5,424,486 | A * | 6/1995 | Aoki | 84/613 |
| 5,510,572 | A * | 4/1996 | Hayashi et al. | 84/609 |
| 5,525,749 | A * | 6/1996 | Aoki | 84/609 |
| 2007/0240559 | A1 * | 10/2007 | Hasebe | 84/637 |

FOREIGN PATENT DOCUMENTS

| | | |
|---|---|---|
| JP | 5-11763 | 1/1993 |
| JP | 5-273976 A | 10/1993 |
| JP | 6-124087 A | 5/1994 |
| JP | 7-028468 A | 1/1995 |
| JP | 9-081145 A | 3/1997 |
| JP | 3099436 B2 | 8/2000 |
| JP | 2006-064746 A | 3/2006 |

OTHER PUBLICATIONS

Japanese Office Action dated Aug. 7, 2012 (and English translation thereof) in counterpart Japanese Application No. 2010-214648.

* cited by examiner

*Primary Examiner* — Jianchun Qin
(74) *Attorney, Agent, or Firm* — Holtz, Holtz, Goodman & Chick

(57) ABSTRACT

A manipulator information obtaining unit obtains at least a note name corresponding to a manipulator manipulated. A storage device includes a register configured to store at least possible note names, note names in a history of manipulators manipulated, and key candidates, and a first table configured to store diatonic scale notes for each of the key candidates. A key determination unit compares the note names in a history of manipulators manipulated with the diatonic scale notes for each of the key candidates and determines whether there is a key candidate in which all of the note names in the history of the manipulators coincide with any of the diatonic scale notes of the key candidate, thereby determining a key of a musical composition played by the manipulation of the manipulators, and storing the determined key in the register.

13 Claims, 24 Drawing Sheets

FIG.15

1500 t

| MELODY NOTE | C | D | E | F | B |
|---|---|---|---|---|---|
| NOTE LENGTH | 480 | 480 | 480 | 480 | 480 |
| PROVISIONAL KEY | C | C | C | C | C |
| PROVISIONAL CHORD | C omit 3 | C omit 3 | C | C | C |
| PROVISIONAL FUNCTION | I<br>T | I<br>T | I<br>T | I<br>T | I<br>T |
| MELODY NOTE HISTORY | C | CD | CDE | CDEF | CDEFB |
| KEY CANDIDATE | CGFB♭E♭A♭D♭ | CGFB♭E♭ | CGF | CF | C |
| DETERMINED KEY | | | | | C |

1501 1502 1503 1504 1505

FIG.16

1600

1601 1602 1603

| KEY | KEY SCALE NOTE | | | | | | | | | | | |
|---|---|---|---|---|---|---|---|---|---|---|---|---|
| | C | C♯ | D | E♭ | E | F | F♯ | G | A♭ | A | B♭ | B |
| G♭ | | D♭ | | E♭ | | F | G♭ | | A♭ | | B♭ | C♭ |
| D♭ | C | D♭ | | E♭ | | F | G♭ | | A♭ | | B♭ | |
| A♭ | C | D♭ | | E♭ | | F | | G | A♭ | | B♭ | |
| E♭ | C | | D | E♭ | | F | | G | A♭ | | B♭ | |
| B♭ | C | | D | E♭ | | F | | G | | A | B♭ | |
| F | C | | D | | E | F | | G | | A | B♭ | |
| C | C | | D | | E | F | | G | | A | | B |
| G | C | | D | | E | | F♯ | G | | A | | B |
| D | | C♯ | D | | E | | F♯ | G | | A | | B |
| A | | C♯ | D | | E | | F♯ | | G♯ | A | | B |
| E | | C♯ | | D♯ | E | | F♯ | | G♯ | A | | B |
| B | | C♯ | | D♯ | E | | F♯ | | G♯ | | A♯ | B |

FIG.17

1700

1701

1702

| | DIATONIC SCALE | | | | | | | | | | | |
|---|---|---|---|---|---|---|---|---|---|---|---|---|
| KEY | C | C♯ | D | E♭ | E | F | F♯ | G | A♭ | A | B♭ | B |
| G♭ | | D♭ | | E♭ | | F | G♭ | | A♭ | | B♭ | C♭ |
| D♭ | C | D♭ | | E♭ | | F | G♭ | | A♭ | | B♭ | |
| A♭ | C | D♭ | | E♭ | | F | | G | A♭ | | B♭ | |
| E♭ | C | | D | E♭ | | F | | G | A♭ | | B♭ | |
| B♭ | C | | D | E♭ | | F | | G | | A | B♭ | |
| F | C | | D | | E | F | | G | | A | B♭ | |
| C | C | | D | | E | F | | G | | A | | B |
| G | C | | D | | E | | F♯ | G | | A | | B |
| D | | C♯ | D | | E | | F♯ | G | | A | | B |
| A | | C♯ | D | | E | | F♯ | | G♯ | A | | B |
| E | | C♯ | | D♯ | E | | F♯ | | G♯ | A | | B |
| B | | C♯ | | D♯ | E | | F♯ | | G♯ | | A♯ | B |

FIG.18

1800

| | AVAILABLE CHORD | | | | | | | | | | | |
|---|---|---|---|---|---|---|---|---|---|---|---|---|
| | C | C# | D | E♭ | E | F | F# | G | A♭ | A | B♭ | B |
| I Major | C | | D | | E | F | | G | | A | | B |
| I M7 | C | | D | | E | F | | G | | A | | B |
| II m | C | | D | | E | F | | G | | A | | B |
| II m7 | C | | D | | E | F | | G | | A | | B |
| II m7-5 | C | | D | | E | F | | G | A♭ | | B♭ | |
| III m | C | | D | | E | F | | G | | A | | B |
| III m7 | C | | D | | E | F | | G | | A | | B |
| III Major | C | | D | | E | | F# | | G# | A | | B |
| III 7 | C | | D | | E | F | | | G# | A | | B |
| III 7sus4 | C | | D | | E | F | | | G# | A | | B |
| IV Major | C | | D | | E | F | | G | | A | | B |
| IV M7 | C | | D | | E | F | | G | | A | | B |
| IV m | C | | D | | E | F | | G | A♭ | | B♭ | |
| IV mM7 | C | | D | | E | F | | G | A♭ | | B♭ | |
| V Major | C | | D | | E | F | | G | | A | | B |
| V 7 | C | | D | | E | F | | G | | A | | B |
| V 7sus4 | C | | D | | E | F | | G | | A | | B |
| VI m | C | | D | | E | | F# | | G# | A | | B |
| VI m7 | C | | D | | E | F | | G | | A | | B |
| VI mM7 | C | | D | | E | | F# | | G# | A | | B |
| VII m7-5 | C | | D | | E | F | | G | | A | | B |

FIG.21

2100

PROVISIONAL CHORD DETERMINATION MAP

| MELODY NOTES | C | C# | D | E♭ | E | F | F# | G | A♭ | A | B♭ | B |
|---|---|---|---|---|---|---|---|---|---|---|---|---|
| CHORD NAMES | C Major | C#Major | Dm | E♭Major | C Major | F Major | F#Major | G Major | Fm | Am | B♭Major | G Major |

FIG.23

2300

| PREVIOUS CHORD FUNCTIONS | C D | C E | C F | C G | C A♭ | C A | C B | ..... |
|---|---|---|---|---|---|---|---|---|
| TO | V Major | I Major | IV Major | I Major | IV m | IV Major | V Major | ..... |
| SU | II m7 | I Major | IV Major | I Major | IV m | IV Major | V Major | ..... |
| DO | V Major | I Major | V Major | I Major | IV m | VI m | I Major | ..... |

KEY DETERMINATION APPARATUS AND STORAGE MEDIUM STORING KEY DETERMINATION PROGRAM

CROSS-REFERENCE TO RELATED APPLICATIONS

This application is based upon and claims the benefit of priority from prior Japanese Patent Application No. 2010-214648, filed Sep. 27, 2010, the entire contents of which are incorporated herein by reference.

BACKGROUND OF THE INVENTION

1. Field of the Invention

The present invention relates a key determination apparatus for determining the key of a musical composition and a storage medium storing a key determination program.

2. Description of the Related Art

In electronic musical instruments with keyboards, as in the piano or organ, a melody is played mainly with the right hand and the accompaniment is played with the left hand. For playing the piano, it is required to practice to be able to move the fingers of the right hand and the fingers of the left hand each independently according to music. Meanwhile, for playing the organ, it is required to press a plurality of keys (manipulators) which constitute a chord correctly with the left hand. In order to play the organ, it requires some practice to play chords.

As described above, in the playing methods for each of the piano and the organ, it requires an appropriate amount of practice to move the right hand and left hand both at the same time. Especially, although beginner players feel it to move the fingers of the right hand for melodies, many of them feel it difficult to press the respective manipulators with the left hand to accompany the right hand. Under these circumstances, there is a demand for an electronic musical instrument such that when the player plays a melody with the right hand, the instrument automatically forms an accompaniment to be played with the left hand, and plays it along the melody.

For example, U.S. Pat. No. 5,296,644 proposes an instrument which stores in advance musical note data of a musical composition for a plurality of sections, and when the chord name is given to the second section of the musical note data, the new chord name is determined with reference to the key data, the musical note data corresponding to the second section, the musical note data of the first section and the chord name previously given to the second section.

It should be noted here that a musical composition does not always have a fixed key, but in many compositions, the starting key changes to another key within one composition by modulation. When the key is modulated, it is necessary to detect to what key the composition is modulated and obtain the new key before the determination of the chord name. Further, at the start of a musical composition or a phrase, it is in many cases difficult to determine in what key the composition or phrase is started.

For example, U.S. Pat. No. 5,302,777 discloses a technique of determining a new key by analyzing the chord pattern between a new chord and a chord preceding the new chord. Further, U.S. Pat. No. 5,296,644 as well discloses a technique of detecting a key based on a determined chord progress.

However, each of the above-described prior art techniques requires to obtain a determined chord progress for detecting the key, and entails a problem that the key cannot be detected simply from a melody sequence.

BRIEF SUMMARY OF THE INVENTION

Accordingly, it is an object of the invention to provide a key determination apparatus and a storage medium storing a key determination program, capable of determining the key appropriately from a melody sequence.

It is another object of the invention to provide a key determination apparatus and a storage medium storing a key determination program, capable of determining the key appropriately from a melody sequence and chord progress even if the key is modulated within a composition.

According to one aspect of the invention, there is provided a key determination apparatus comprising: a manipulator information obtaining unit configured to obtain at least a note name corresponding to a manipulator manipulated; a storage device including a register configured to store at least possible note names, note names in a history of manipulators manipulated, and key candidates, based on information obtained by the manipulator information obtaining unit, and a first table configured to store diatonic scale notes for each of the key candidates; and a key determination unit configured to compare the note names in the history of manipulators manipulated with the diatonic scale notes for each of the key candidates and determine whether there is a key candidate in which all of the note names in the history of the manipulators coincide with any of the diatonic scale notes of the key candidate, thereby determining a key of a musical composition played by the manipulation of the manipulators, and storing the determined key in the register.

According to another aspect of the invention, there is provided a key determination apparatus comprising: a manipulator information obtaining unit configured to obtain at least a note name corresponding to a manipulator manipulated; a storage device including a register configured to store at least possible note names, note names in a history of manipulators manipulated, and key candidates, based on information obtained by the manipulator information obtaining unit, and a second table configured to store a tritone specific to each key and scale notes within the triton of the diatonic scale notes for each of the key candidates; and a key determination unit configured to compare the note names in the history of manipulators with the second table and determine whether there is a key candidate in which the note names in the history of the manipulators contain a tritone of the key candidate and scale notes within the tritone, thereby determining a key of a musical composition played by the manipulation of the manipulators, and storing the determined key in the register.

According to still another aspect of the invention, there is provided a non-transitory computer-readable storage medium having program code stored thereon for performing key determination in a computer equipped with a storage device including a register configured to store at least possible note names, note names in a history of manipulators manipulated, and key candidates, and a first table configured to store diatonic scale notes for each of the key candidates, the program code comprising: executing a manipulator information obtaining process of obtaining at least a note name corresponding to a manipulator manipulated and storing obtained information in the register; and executing a key determination process of comparing the note names in the history of manipulators manipulated with the diatonic scale notes for each of the key candidates and determining whether there is a key candidate in which all of the note names in the history of the manipulators coincide with any of the diatonic scale notes of the key candidate, thereby determining a key of a musical composition played by the manipulation of the manipulators, and storing the determined key in the register.

According to still another aspect of the invention, there is provided a non-transitory computer-readable storage medium having program code stored thereon for performing key determination in a computer equipped with a storage device including a register configured to store at least possible note names, note names in a history of manipulators manipulated, and key candidates, and a second table configured to store a tritone specific to each key and scale notes within the triton of the diatonic scale notes for each of the key candidates, the program code comprising: executing a manipulator information obtaining process of obtaining at least a note name corresponding to a manipulator manipulated and storing obtained formation in the register; and executing a key determination process of comparing the note names in the history of manipulators with the second table and determining whether there is a key candidate in which the note names in the history of the manipulators contain a tritone of the key candidate and scale notes within the tritone, thereby determining a key of a musical composition played by the manipulation of the manipulators, and storing the determined key in the register.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 15 is a diagram showing an example of the diatonic register according to the embodiment;

FIG. 16 is a diagram showing an example of the key note scale table according to the embodiment;

FIG. 17 is a diagram showing an example of the diatonic scale table according to the embodiment;

FIG. 18 is a diagram showing an example of the chord data base according to the embodiment;

FIG. 21 is a diagram showing an example of the provisional chord determination map according to the embodiment;

FIG. 23 is a diagram showing an example of the chord determination table according to the embodiment.

DETAILED DESCRIPTION OF THE INVENTION

An embodiment of the present invention will now be described with reference to accompanying drawings.

Figure 1:
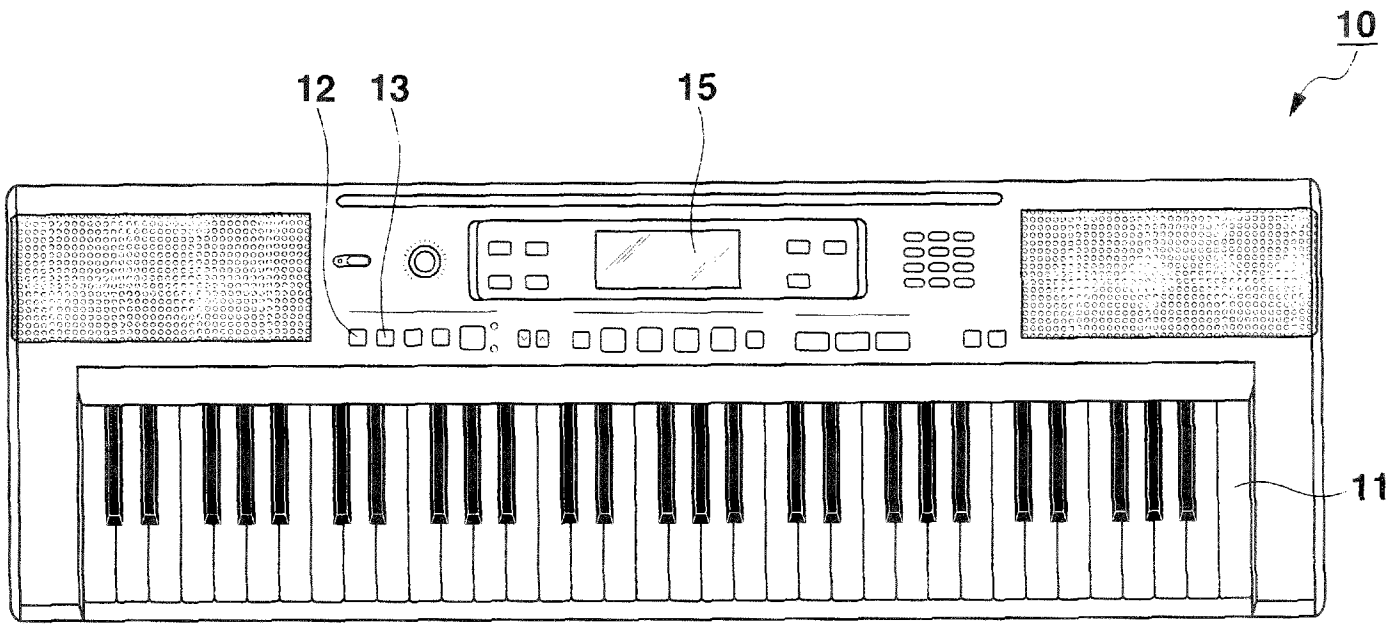
FIG. 1 is a diagram showing an appearance of an electronic instrument according to an embodiment of the present invention.

FIG. 1 is a diagram showing an appearance of an electronic instrument according to this embodiment. As shown in FIG. 1, an electronic instrument 10 according to this embodiment includes a keyboard 11. On the top of the keyboard 11, switches (see reference numerals 12 and 13) designed to assign tone colors, start and finish automatic accompaniments, assign rhythm patterns, etc., and a display unit 15 which displays various information items regarding a musical composition played, for example, the tone colors, rhythm patterns, chord names, etc. are provided. The electronic instrument 10 of this embodiment includes, for example, 61 keys (C2 to C7). Further, the electronic instrument 10 can be played in one of the two modes, that is, the automatic accompaniment mode in which the automatic accompaniment is turned on, and the normal mode in which the automatic accompaniment is off.

Figure 2:
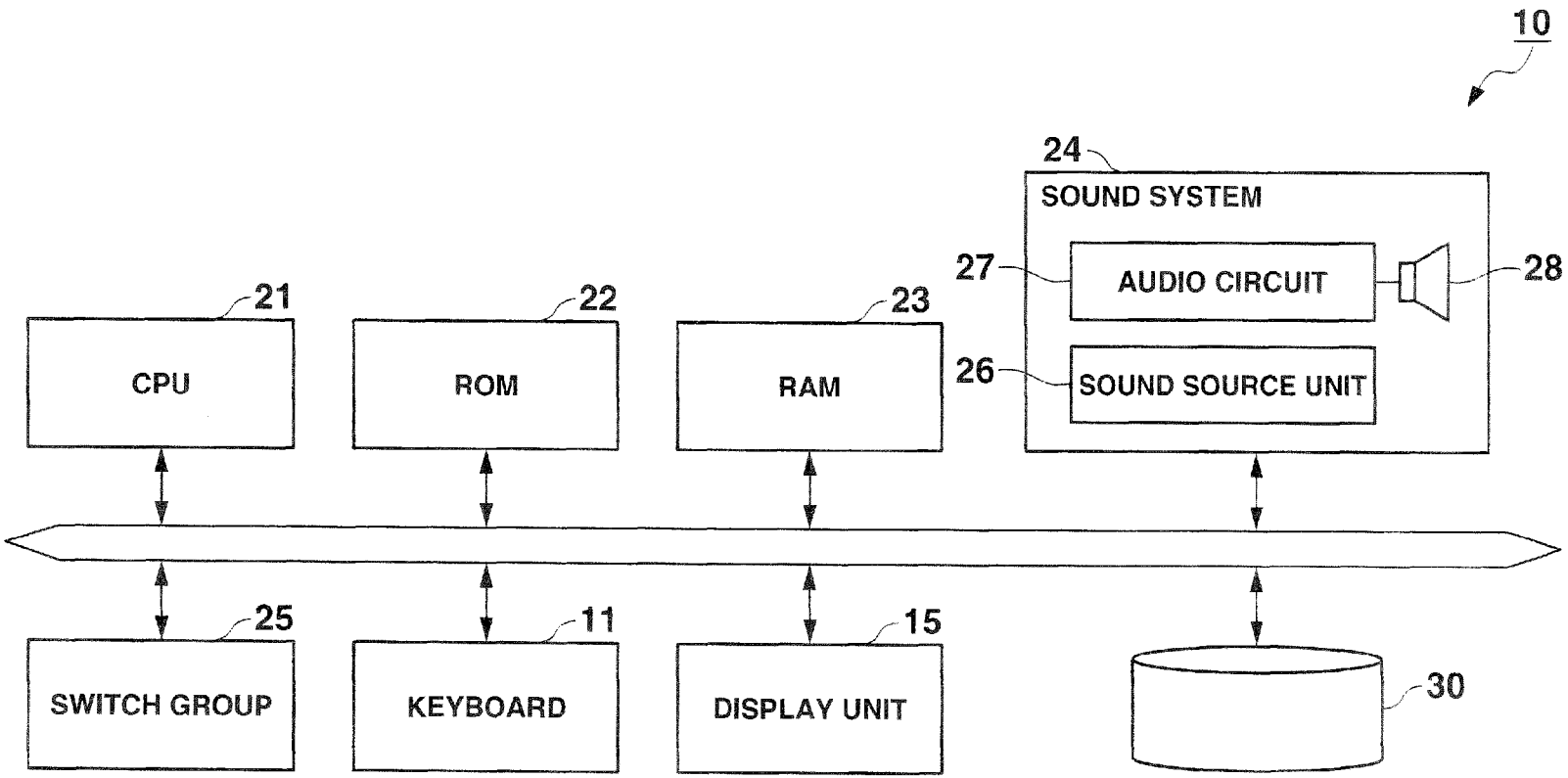
FIG. 2 is a block diagram showing the configuration of the electronic instrument according to the embodiment of the present invention.

FIG. 2 is a block diagram showing the configuration of the electronic instrument according to the embodiment of the present invention. As shown in FIG. 2, the electronic instrument 10 of this embodiment includes a CPU 21, a ROM 22, a RAM 23, a sound system 24, a group of switches 25, a large-scale storage device 30, the keyboard 11 and the display unit 15.

The CPU 21 executes various types of processes which include the control of the entire operation of the electronic instrument 10, the detection of pressing of a manipulator(s) of the keyboard 11 and manipulation on a switch(es) (see, for example, reference numerals 12 and 13 in FIG. 1) of the switch group 25, the control of the sound system 24 according to the operation on the keys and switches, the determination of the key of the musical composition being played and the determination of the chord name according to the pitch of the musical note of a manipulator pressed, the automatic accompaniment pattern, the playing of the automatic accompaniment according to the key and the chord names, etc.

The ROM 22 stores the programs of various types of processes executed by the CPU 21, which includes, for example, the detection of pressing of the manipulator (s) of the keyboard 11 and manipulation on a switch(es) (see, for example, reference numerals 12 and 13 in FIG. 1) of the switch group 25, the control of the sound system 24 according to the operation on the keys and switches, the determination of the key of the musical composition being played and the determination of the chord name according to the pitch of the musical note of the manipulator pressed, the automatic accompaniment pattern, the playing of the automatic accompaniment according to the key and the chord names, etc. Further, the ROM 22 includes a waveform data area which stores waveform data for generating the musical sounds of the piano, guitars, bass drums, snare drums, cymbals, etc., and an automatic accompaniment pattern area which stores the data (automatic accompaniment data) indicating various types of automatic accompaniment patterns.

The RAM 23 stores programs read out from the ROM 22 and data generated in the process of an operation. The data generated in the process of an operation includes, for example, the diatonic register, which will be explained later. Further, in this embodiment, the automatic accompaniment patterns include melody automatic accompaniment patterns each including melody notes and obligate notes, chord automatic accompaniment patterns each including constituent notes for each chord name, and rhythm patterns each including drum sounds. For example, a record of the data of a melody automatic accompaniment pattern includes tone colors, pitches, timing of sound generation (time at which the sound is generated), the length of note. A record of the data of a chord automatic accompaniment pattern includes data which indicates the chord constituent notes in addition to the above-described information. Further, the data of a rhythm pattern include the tone color of each musical note, and the timing of sound generation.

The sound system 24 includes a sound source unit 26, an audio circuit board 27 and a speaker 28. The sound source unit 26, upon reception of the information on a manipulator(s) pressed or the information on an automatic accompaniment pattern from the CPU 21, reads out a predetermined waveform data item from the waveform data area of the ROM 22, and generates musical note data of a predetermined sound pitch, to be output. Further, the sound source unit 26 can output the waveform data of a tone color of a percussion, especially, a snare drum, a bass drum, a cymbal, directly as musical note data. The audio circuit board 27 digital/analogue-converts the musical note data and amplifies the converted data. In this manner, the acoustic signal is output from the speaker 28.

The large-scale storage device 30 includes a hard disk drive or a memory card. The large-scale storage device 30 stores various types of tables including the diatonic scale table, the key scale note table, the provisional chord determination map and the available chord table.

In the normal mode, the electronic instrument 10 according to the embodiment generates a musical note based on the pressing of a manipulator of the keyboard 11. When the automatic accompaniment switch (not shown in the figure) is turned on, the electronic instrument 10 enters the automatic accompaniment mode. In the automatic accompaniment mode, when a manipulator is pressed, the instrument generates the musical tone of the pitch of the key. Further, based on the pitch of the manipulator pressed, the key of the composition and the chord name are determined, and the musical sound is generated in accordance with the key and the automatic accompaniment pattern including the chord constituent notes of the chord name. It should be noted here that the automatic accompaniment pattern includes a melody automatic accompaniment pattern and a chord automatic accompaniment pattern, in which the musical pitches vary as in the sound of the piano, guitar or the like, and a rhythm pattern in which the musical pitches do not vary as in the sound of the bass drum, snare drum, cymbal, or the like. The case where the electronic instrument 10 operates in the automatic accompaniment mode will now be described.

Figure 3:
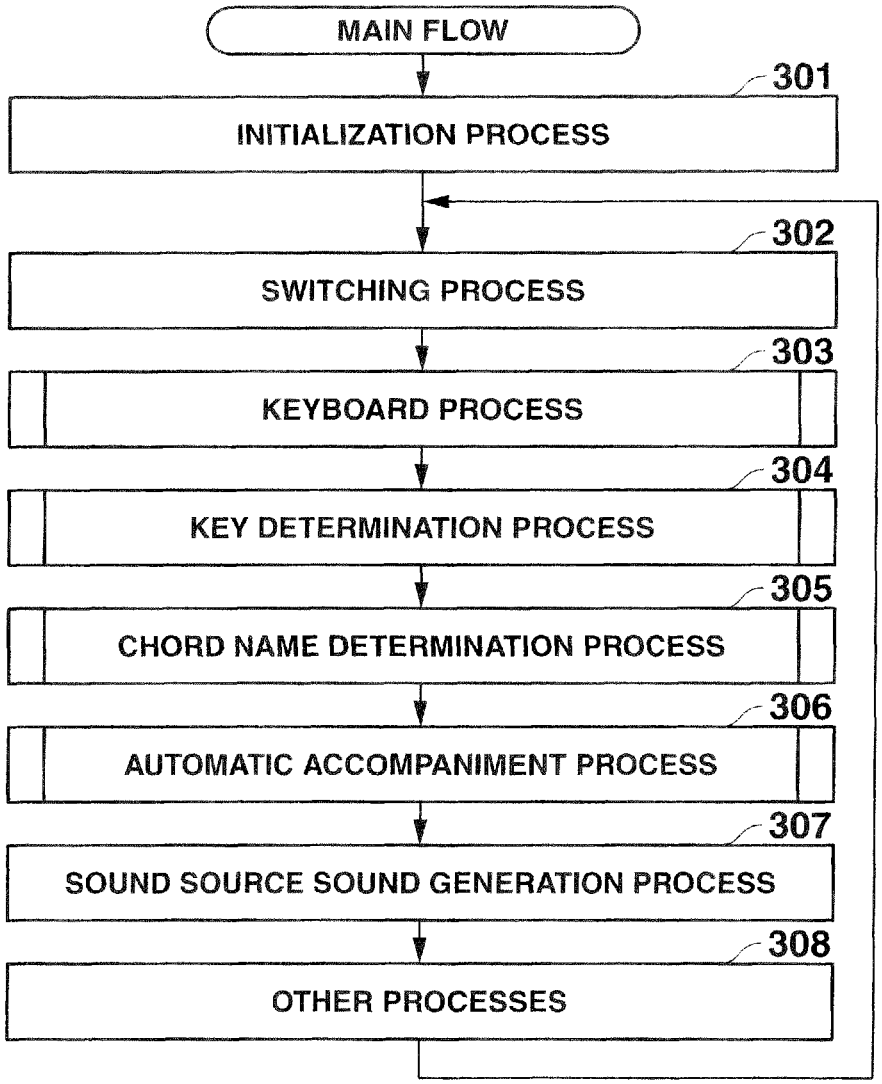
FIG. 3 is a flowchart showing an example of the main flow to be executed in the electronic instrument according to the embodiment.

The following are detailed descriptions of the process executed by the electronic instrument 10 according to the embodiment. FIG. 3 is a flowchart showing an example of the main flow executed in the electronic instrument 10 according to this embodiment. Although it is now shown in the figure, the timer increment process is executed as well, in which the counter value of the interruption is incremented at predetermined time intervals during the execution of the main flow.

As shown in FIG. 3, when the power of the electronic instrument 10 is turned on, the CPU 21 of the electronic instrument 10 executes the initial process (initializing process), which includes the clearing of the data in the RAM 23 and the image displayed on the display unit 15 (step 301). Further, in the initial process, various tables stored in the large-scale storage device 30 are copied in the RAM 23. When the initial process (step 301) is finished, the CPU 21 detects the operations of the respective switches of the switch group 25 and executes the switching process in which the processes are executed in accordance with the detected operations (step 302).

For example, in the switching process (step 302), various types of switching operations are detected, including the tone color assignment switch, the automatic accompaniment pattern type assignment switch, the automatic accompaniment pattern on/off assignment switch, etc. When the automatic accompaniment pattern is on, the CPU 21 switches the play mode to the automatic accompaniment mode. The data indicating the play mode are assigned to predetermined region of the RAM 23. The data indicating the tone color and the type of the automatic accompaniment pattern are similarly assigned to a predetermined region of the RAM 23.

Figure 4:
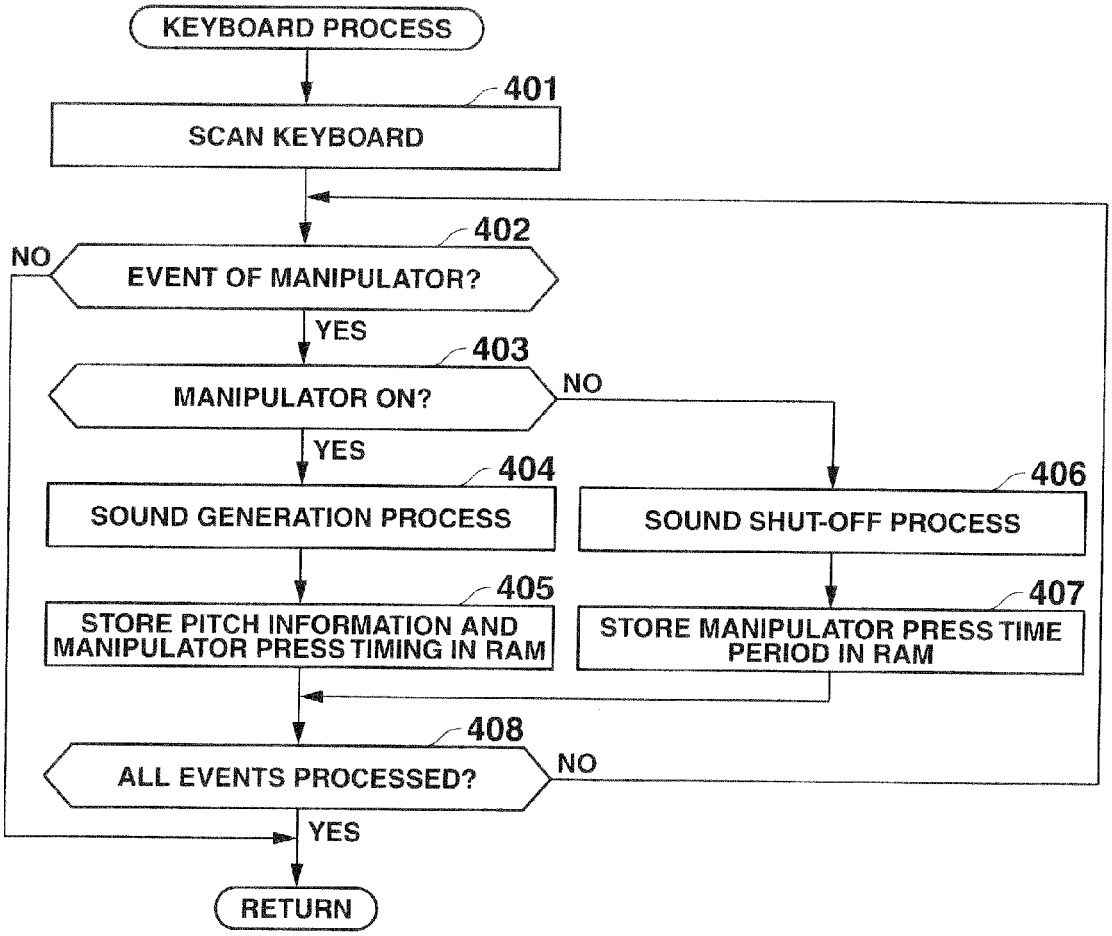
FIG. 4 is a flowchart showing an example of keyboard process according to the embodiment in more detail.

Next, the CPU 21 executes the keyboard process (step 303). FIG. 4 is a flowchart showing an example of keyboard process according to the embodiment in more detail. In the keyboard process, the CPU 21 scans the manipulators of the keyboard 11. An even which is the result of a scan of the manipulators (on or off of each of the manipulators) is temporarily stored in the RAM 23 together with the information of the time at which the event occurred. The CPU 21 determines with reference to the scanning results of the manipulators stored in the RAM 23 (step 401) as to whether or not there is an event of a manipulator (step 402). If it is "Yes" in the step 402, the CPU 11 determines whether or not the event is Manipulator-On (step 403).

If it is "Yes" in the step 403, the CPU 21 executes the sound generation process for the manipulator where the event of Manipulator-On occurred (step 404). In the sound generation process, the CPU 21 reads out the tone color data for the manipulator dedicated to melody and the data indicating the pitch of the manipulator, stored in the RAM 23, and temporarily store them in the RAM 23. In the sound generation process (the step 307 in FIG. 3), the data indicating the tone color and the pitch are given to the sound source unit 26. In accordance with the data indicating the tone color and the pitch, the sound source unit 26 reads out the waveform data in the ROM 22, and generates musical note data of a predetermined pitch. In this manner, the predetermined musical sound is generated from the speaker 28.

After that, the CPU 21 stores the pitch data (for example, the key number) of the manipulator in which the event of Manipulator-On occurred, and the manipulator press timing (for example, the time at which the manipulator is pressed) in the RAM 23 (step 405). The manipulator press timing can be calculated based on the counter value of the interrupt counter.

If it is "No" in the step 403, the event of Manipulator-Off occurred. Therefore, the CPU 21 executes the sound shut-off process for the manipulator in which the event of Manipulator-Off occurred (step 406). In the sound shut-off process, the CPU 21 generates data which indicates the pitch of the musical note to be shut off, and stores the data temporarily in the RAM 23. In this case as well, the data indicating the tone color and pitch of the musical note to be shut off is given to the sound source unit 26 in the sound source sound generation process (step 306). The sound source unit 26 shuts off the predetermined musical note based on the data given. After that, the CPU 21 stores in the RAM 23 the time period of the manipulator being pressed before the event of Manipulator-Off occurred (i.e., manipulator press time) (step 407).

The CPU 21 determines whether the processes have been finished for all of the events of manipulators (step 408). When it is determined as "No" in the step 408, the operation returns to the step 402.

Figure 5:
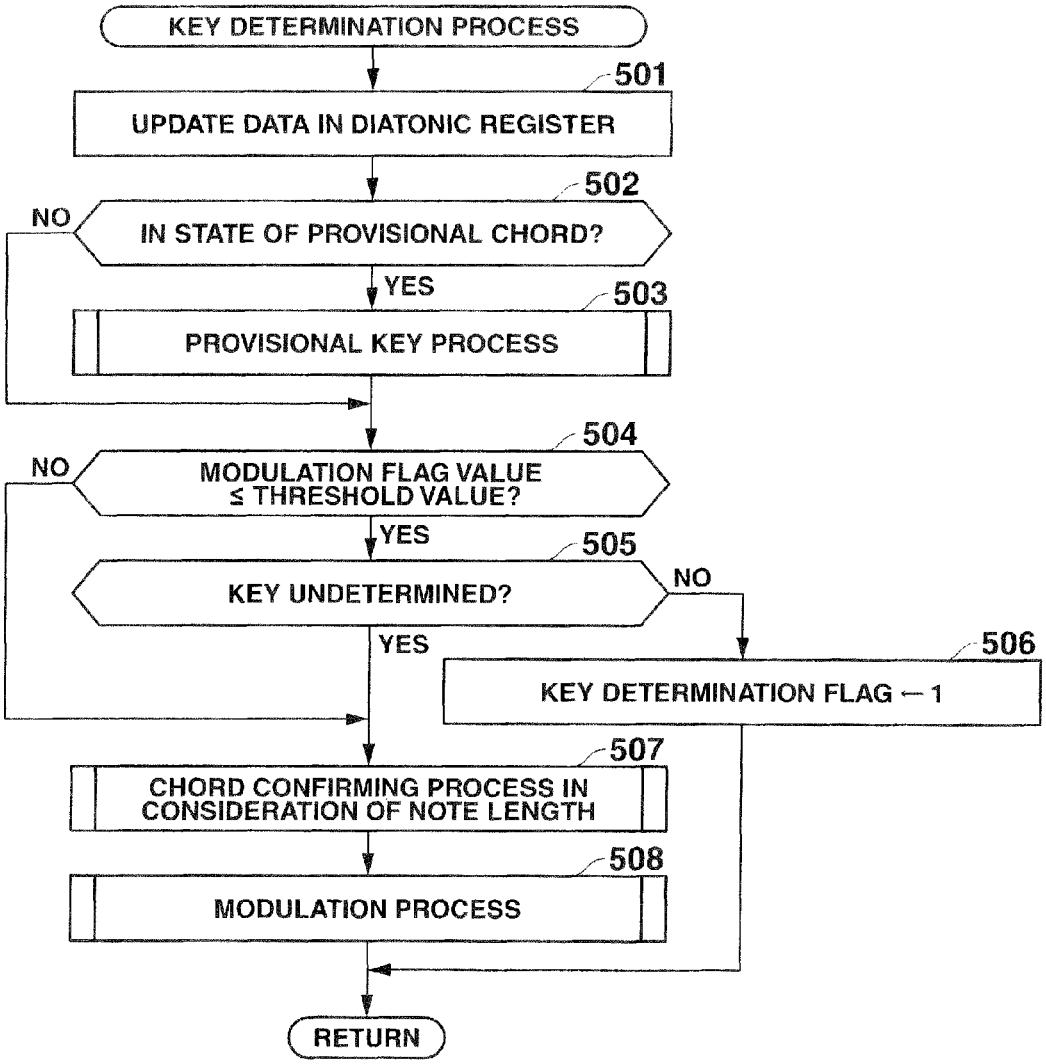
FIG. 5 is a flowchart showing an example of the key determination process according to the embodiment.

When the keyboard process (the step 303 in FIG. 3) is finished, the CPU 21 executes the key determination process (step 304). FIG. 5 is a flowchart showing an example of the key determination process according to the embodiment. As shown in FIG. 5, the CPU 21 updates the data in the diatonic register stored in the RAM 23 (step 501).

FIG. 15 is a diagram showing an example of the diatonic register according to the embodiment. In this embodiment, each time the manipulator of a melody note is pressed, the values are stored in series of items in a diatonic register 1500. In the example of FIG. 15, a series of values are stored for each of 5 melody notes in time sequence (reference numerals 1501 to 1505). In FIG. 15, the value of the pressing of the manipulator is newer in the time sequence towards the direction of the arrow t. More specifically, as the manipulators are pressed in the order of "C", "D", "H", "F" and "B" as in the items of the melody notes.

In this embodiment, for a plurality of melody notes, the values of the items which will be described below are stored in unit registers 1501 to 1505 of the diatonic register 1500. The unit registers 1501 to 1505 each includes the items of the melody note, note length, provisional key, provisional chord, provisional function, melody note history, key candidate register and determined key, and the unit register can store the values of these items. In the item of melody note, the note name corresponding to the manipulator pressed is stored. On the other hand, in the note length, the time period of the manipulator being pressed is stored.

When the key is determined in the end, the name of the key is stored in the item of the determined key of the unit register (for example, unit register 1505 storage). However, in order to confirm whether a key has been determined, it is required that a plurality of manipulators should be pressed. Therefore, in this embodiment, until the stage where it is confirmed that the key can be determined, a provisional key is specified by the process, and the name of the provisional key is stored in the item of the provisional key of the unit register. Further, in line with the provisional key, the name of a provisional chord appropriate for the melody notes is stored in the item of the provisional chord. Furthermore, in the item of the provisional function, the function of the provisional chord under the provisional key (that is, the name of the chord of the case where the tonic is expressed as I, and the type of tonic (T), dominant (D) or subdominant (S)) is stored.

In the melody note history, a note name corresponding to a manipulator pressed from the start of the play or from a predetermined timing is stored. For example, in the unit register 1501 for the first manipulator pressed, only C, which corresponds to the manipulator pressed, is stored, and in the unit register 1502 for the next manipulator pressed, C and D of two keys, are stored. In the key candidate, the name of one or more possible keys is stored when the manipulator is pressed.

In the step 501, values are stored in the melody note, note length, melody note history, etc. of a new unit register. Next, the CPU 21 determines, with reference to the unit register for the latest manipulator pressed, whether the current state is in the provisional chord (step 502). The provisional chord state is the state where no value is stored in the item of the determined key. If it is "Yes" in the step 502, the CPU 21 executes the provisional key process (step 503).

Figure 6:
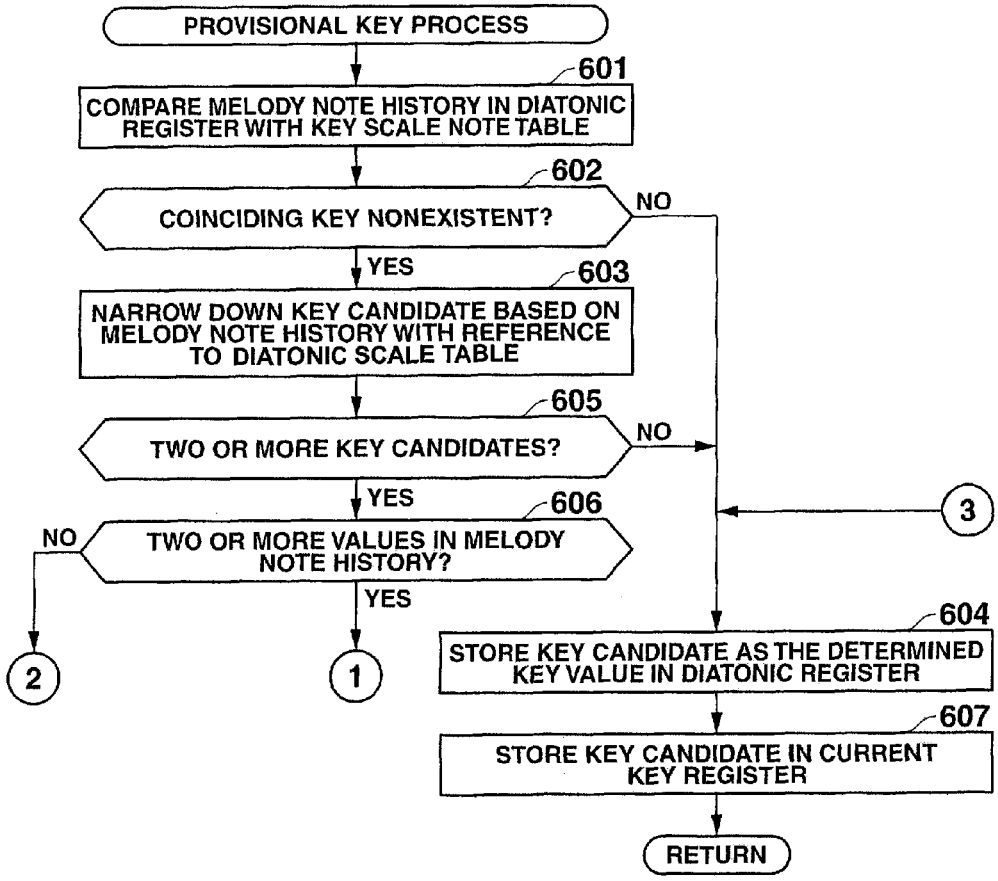
FIG. 6 is a flowchart showing an example of the provisional key process according to the embodiment in the first part.
Figure 7:
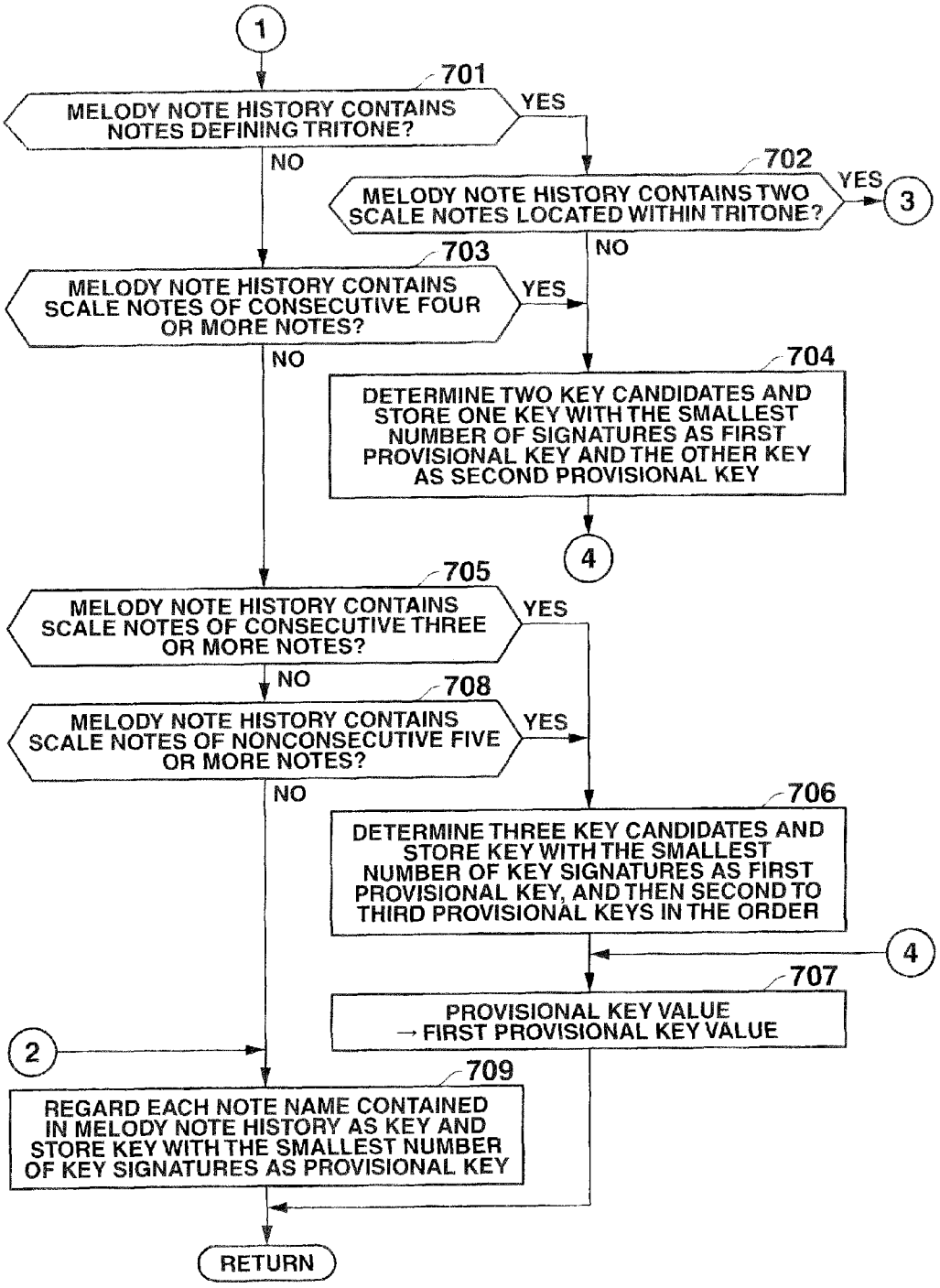
FIG. 7 is a flowchart showing the example of the provisional key process according to the embodiment in the last part.

FIGS. 6 and 7 are flowcharts showing an example of the provisional key process according to this embodiment. As shown in FIG. 6, the CPU 21 compares the melody note history of the unit register for the latest manipulator pressed in the diatonic register 1501 with the key scale note table stored in the RAM 23 (step 601). FIG. 16 is a diagram showing an example of the key note scale table according to this embodiment. A key scale note table 1600 stores key scale notes for each of the 12 keys from C to B, and an identifier such as flag is given for the tritone specific to each key and 4 note names including the scale notes within the tritone.

In the key note scale 1600 shown in FIG. 16, when the key is C, for example, 4 notes, F, G, A and B are the note names to which the identifiers are given (see reference numeral 1601). When the key is G, for example, 4 notes, C, U, E and F# are the note names to which the identifiers are given (see reference numeral 1602). When the key is D, for example, 4 notes, G, A, B and C# are the note names to which the identifiers are given (see reference numeral 1603).

In the step 601, the melody note history is compared with the key scale note table 1600, and it is determined as to whether there is a key that all of the note names stored in the melody note history coincide with any of the note names to which the identifiers are given. In the case where it is determined that there is the coincidence as a result of the comparison (that is, "No" in the step 602), the above-mentioned key is stored as the value of the determined key in the unit register of the diatonic register 1500 (step 604). Further, the CPU 21 stores the above-mentioned key in the current key register stored in the RAM 23 (step 607).

On the other hand, in the case of "Yes" in the step 602, where it is determined that there is no coincidence as a result of the comparison, the CPU 21 narrows down the key candidates based on the melody note history with reference to the diatonic scale table stored in the RAM 23 (step 603).

FIG. 17 is a diagram showing an example of the diatonic scale table according to the embodiment. As shown in FIG. 17, the values stored in the diatonic scale table are identical to those of the key scale note table shown in FIG. 16 except that the identifiers are given to predetermined notes. Therefore, it is alternatively possible to configure the embodiment to refer to the key scale note table without providing the diatonic scale table separately. In the diatonic scale table shown in FIG. 17, when the key is C, for example, the note names, C, D, E, F, G, A and B are stored (see reference numeral 1701). When the key is G, for example, the note names, G, A, B, C, D, E and F# are stored (see reference numeral 1702).

In the step 603, the melody note history is compared with the diatonic scale table 1700 so as to determine whether there is a key in which all of the note names in the melody note history are included in the diatonic scale of the key. There may not be such a key, or there may be more than one such keys. For example, in the melody note history of the unit register 1503, C, D and E are stored. Here, with reference to the diatonic scale table 1700, it is understood that there are 3 keys which contain all of C, D and E as the diatonic scale, which are C, G and F. Therefore, in this case, these 3 keys, C, G and F can be the key candidates.

The CPU 21 determines as to whether there are two or more key candidates found in the step 603 (step 605). If it is "No" in the step 605, that is, in the case where there is only one key candidate, the operation proceeds to the step 604. Thus, the CPU stores this key candidate as the value for the determined key in the unit register of the diatonic register 1500 (step 604). Further, the CPU 21 stores the key candidate in the current key register stored in the RAM 23 (step 607).

If it is "Yes" in the step 605, the CPU 21 determines whether there are two or more values (note names) stored in the melody note history (step 606). If it is "No" in the step 606, the operation proceeds the step 709. In the step 709, the CPU 21 regards each note contained in the melody note history as a key and determines a key with the smallest number of key signatures, and stores the determined key as a value of the provisional key in the unit register (step 709). Note that when there are two or more key candidates having the same number of key signature(s) (for example, F and C, U and B♭), the key containing note(s) with # takes priority and is set as the provisional key.

If it is "Yes" in the step 606, the CPU 21 determines whether the melody note history contains two notes defining a tritone (step 701). Note that the tritone is defined by two notes as the musical interval of three whole tones (augmented fourth or diminished fifth). Therefore, in the step 701, it is determined whether two notes defining the musical interval of three whole tones are contained in the melody note history.

If it is "Yes" in the step 701, the CPU 21 determines whether the melody note history contains two notes located within the tritone (step 702). If it is "Yes" in the step 702, the operation proceeds to the step 604. This is the same result as that of the case where it is determined as "No" in the step 602.

If it is "No" in the step 702, two key candidates are obtained. As is understood from the key note scale 1600 shown in FIG. 16, there are two keys which include the identical tritons. For example, there are two keys, C and G♭ which have the tritone defined by F and B in the scale notes. Then, the CPU 21 specifies the two key candidates and stores the one with the less key signatures as the first provisional key, and the other one with the more key signature as the second provisional key in the RAM 23 (step 704). After that, the operation proceeds to the step 707, and the CPU 21 stores the value of the first provisional key as the provisional key of the unit register.

If it is "No" in the step 701, the CPU 21 determines whether the melody note history contains scale notes of consecutive four notes or more (step 703). There are two keys which have the identical scale notes of consecutive 4 notes or more. Therefore, even in the case where it is determined as "Yes" in the step 703, it is processed as in the case where it is determined as "No" in the step 702. More specifically, the CPU 21 specifies the two key candidates and stores the one with the less key signatures as the first provisional key, and the other one with the more key signature as the second provisional key in the RAM 23 (step 704). After that, the operation proceeds to the step 707, and the CPU 21 stores the value of the first provisional key as the provisional key of the unit register.

If it is "No" in the step 703, the CPU 21 determines whether the melody note history contains scale notes of consecutive three notes (step 705). If it is "No" in the step 705, the CPU 21 determines whether the melody note history contains scale notes of nonconsecutive five notes or more (step 708). If it is "Yes" in the step 705 or as "Yes" in the step 708, three key candidates are obtained. Then, the CPU 21 specifies the three key candidates and stores the one with the smallest number of key signatures as the first provisional key, the one with the second-smallest number of key signatures as the second provisional key, and other one with the largest number of key signatures as the third provisional key in the RAM 23 (step 706). After that, the operation proceeds to the step 707, and the CPU 21 stores the value of the first provisional key as the provisional key of the unit register.

If it is "No" in the step 708, the CPU 21 regards each note contained in the melody note history as a key and determines a key with the smallest number of key signatures, and stores the determined key as a value of the provisional key in the unit register (step 709).

If it is "No" in the step 502 or the provisional key process (step 503) is finished, the CPU 21 determines whether the modulation flag value is a predetermined threshold value or less (step 504). Note that the modulation flag value is a value incremented when an appropriate chord name is not determined in the chord name determination process (step 305). If it is "Yes" in the step 504, the CPU 21 confirms whether the key is undetermined (step 505). This confirmation can be made by checking if a value is stored in the item of the determined key in the latest unit, register of the diatonic register.

Figure 8:
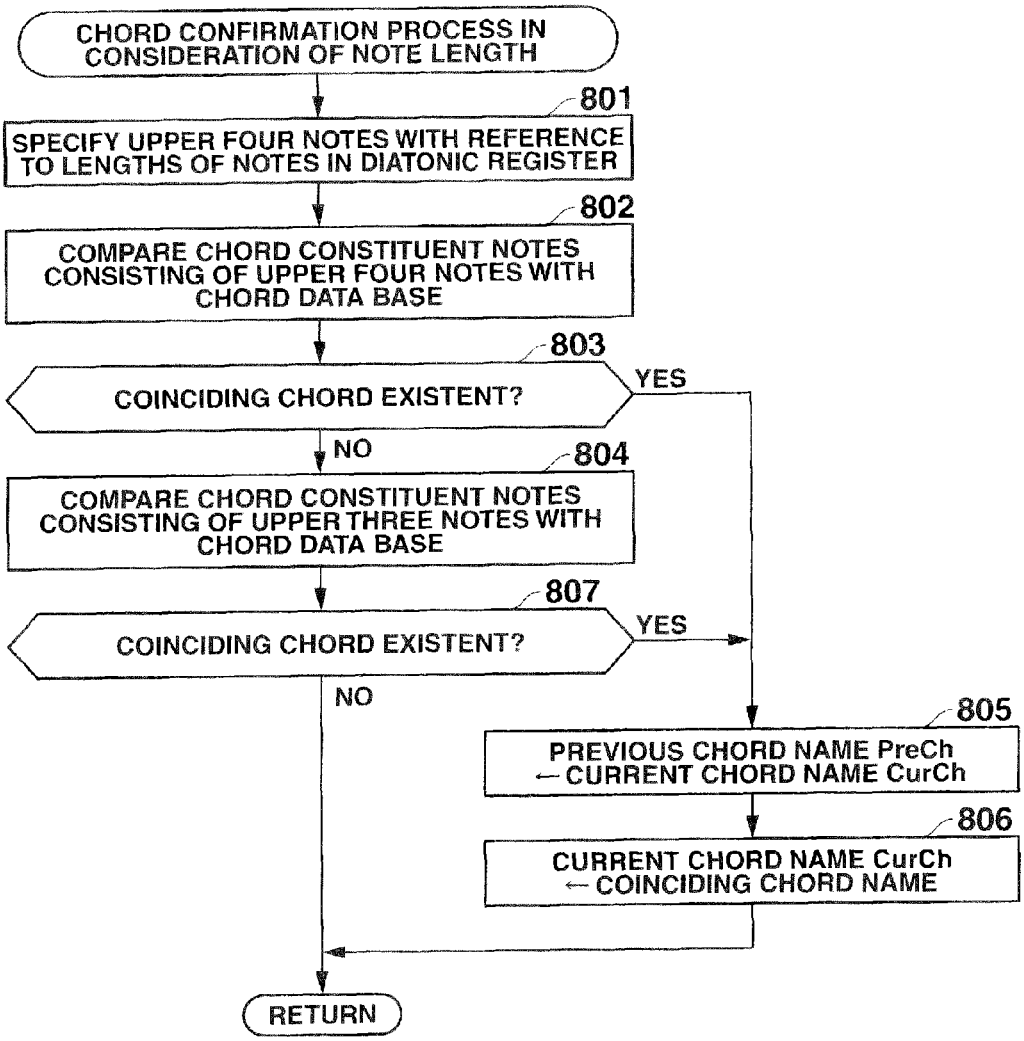
FIG. 8 is a flowchart showing an example of the chord confirming process in consideration of the note length according to the embodiment.

If it is "No" in the step 505, that is, a value has been stored in the item of the determined key and the key has been determined, the CPU 21 sets the key determination flag in the RAM 23 to "1" (step 506). If it is "No" in the step 504 (that is, the modulation flag value is larger than the threshold value) or it is "Yes" in the step 505, the chord confirming process in consideration of the length of the note is carried out (step 507). FIG. 8 is a flowchart showing an example of the chord confirming process in consideration of the note length according to the embodiment.

As shown in FIG. 8, in the chord confirming process in consideration of the note length, the CPU 21 specifies the note names of the upper four melody notes from the longest note with reference to the lengths of the notes in the unit register of the diatonic register (step 801). Then, the CPU 21 compares the chord constituent notes consisting of the melody notes specified in the step 801 with the chord data base (step 802). FIG. 18 is a diagram showing an example of the chord data base according to the embodiment. As shown in FIG. 18, the chord data base 1800 stores the chord constituent notes for each chord and the scale notes for each chord. In FIG. 18, the notes indicated by hatching are the chord constituent notes.

The CPU 21 determines whether there is a chord name in the chord data base 1800 which contains the chord constituent notes coinciding with the above-mentioned four chord constituent notes (step 803). If it is "No" in the step 803, the CPU 21 compares the chord constituent notes of the chord consisting of the upper three melody notes from the longest note with the chord data base (step 804). Next, the CPU 21 determines whether there is a chord name in the chord data base 1800 which contains the chord constituent notes coinciding with the above-mentioned three chord constituent notes (step 807).

If it is "Yes" in the step 803 or it is "Yes" in the step 807, the CPU 21 stores the current chord name CuRCh stored in the RAM 23 as the previous chord name PreCh (step 805). Further, the CPU 21 stores the chord name which is determined to coincide in the step 803 or step 807, as the current chord name CurCh (step 806).

It should be noted here that the chord name is not a relative chord name when C is fixed as a tonic, but is the name which uses a note name. For example, in the available chord table, IMaj and IVMaj are obtained, the current chord names CurCh are C (CMaj) and F (FMaj), respectively.

Figure 9:
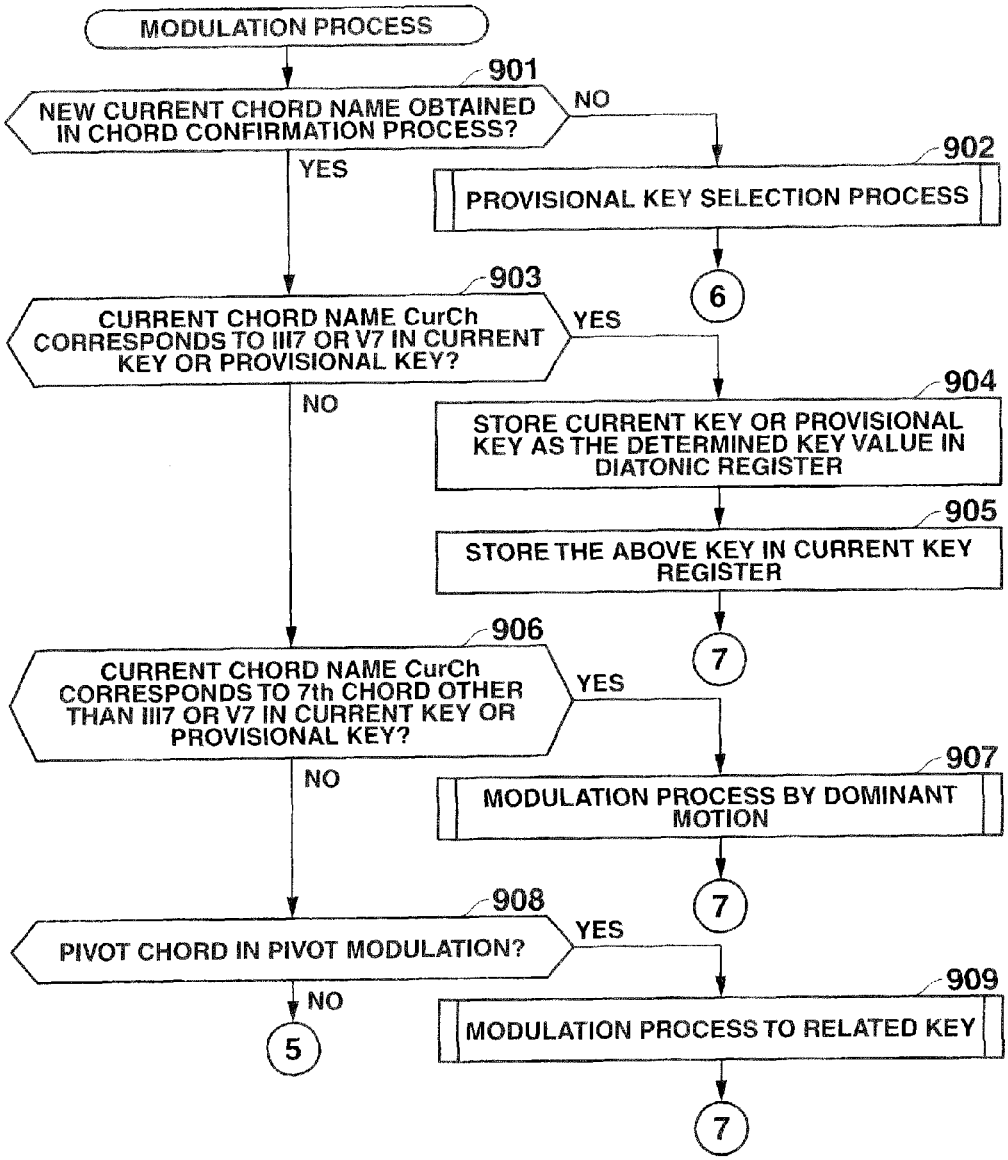
FIG. 9 is a flowchart showing an example of the modulation process according to the embodiment in the first part.
Figure 10:
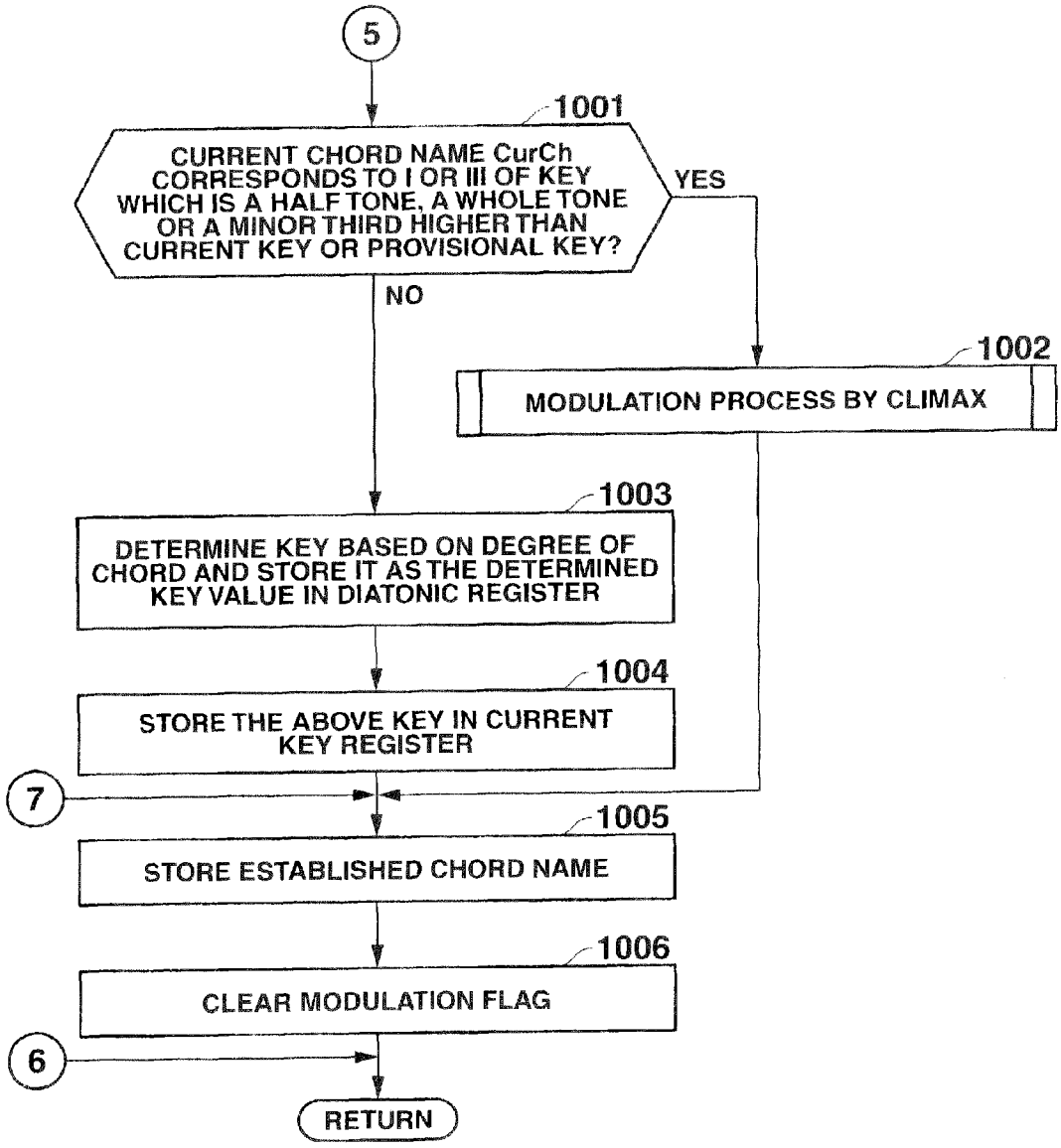
FIG. 10 is a flowchart showing the example of the modulation process according to the embodiment in the last part.

After that, the CPU 21 executes the modulation process (step 508). FIGS. 9 and 10 are flowcharts showing an example of the modulation process according to the embodiment. As shown in FIG. 9, the CPU 21 determines whether a new current chord name CurCh is obtained in the previously executed chord confirming process (step 901). If it is "No" in the step 901, the provisional key selection process is carried out (step 902). The provisional key selection process will be explained later.

If it is "Yes" in the step 901, the CPU 21 determines whether the new current chord name CurCh corresponds to III7 or V7 in the current key or the provisional key (step 903). If it is "Yes" in the step 903, the CPU 21 stores the key in which the current chord name is III7 or V7, that is, the current key or provisional key as the determined key value in the unit register of the diatonic register (step 904). Further, the CPU 21 stores the above-mentioned key in the current key register in the RAM 23 (step 905).

Figure 11:
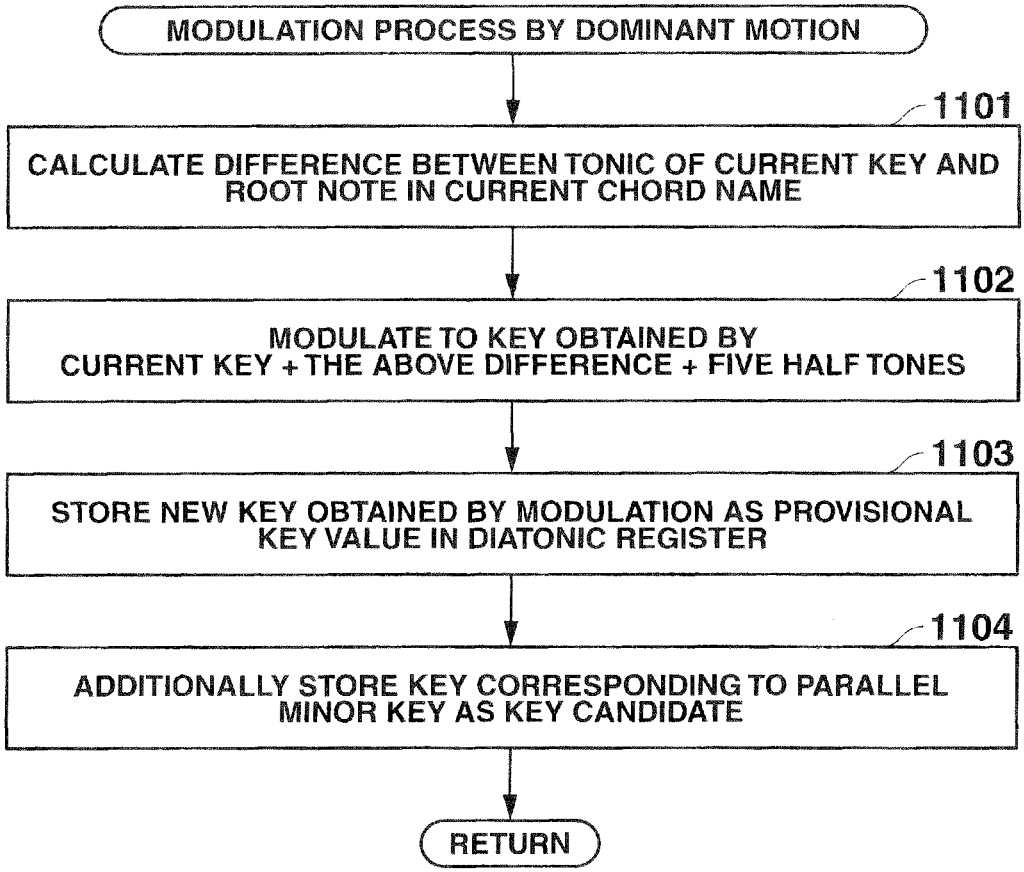
FIG. 11 is a flowchart showing an example of the modulation process by the dominant motion.

If it is "No" in the step 903, the CPU 21 determines whether the new current chord name CurCh corresponds to a seventh chord other than III7 or V7 in the current key or the provisional key (step 906). If it is "Yes" in the step 906, the modulation process by the dominant motion is carried out (step 907). FIG. 11 is a flowchart showing an example of the modulation process by the dominant motion.

As shown in FIG. 11, in the modulation process by the dominant motion, the CPU 21 calculates the difference between the tonic of the current key and the fundamental note in the current chord name (step 1101). The CPU 21 obtains the note name by calculation of the current key+the difference obtained in the step 1101+five half tones (step 1102).

Next, the CPU 21 stores the note name obtained in the step 1102 as the value of the provisional key in the unit register of the diatonic register (step 1103). Further, the CPU 21 additionally stores the key corresponding to the parallel minor key of the above-calculated key (which is a minor third lower) in the item of the key candidate in the unit register (step 1104).

Figure 12:
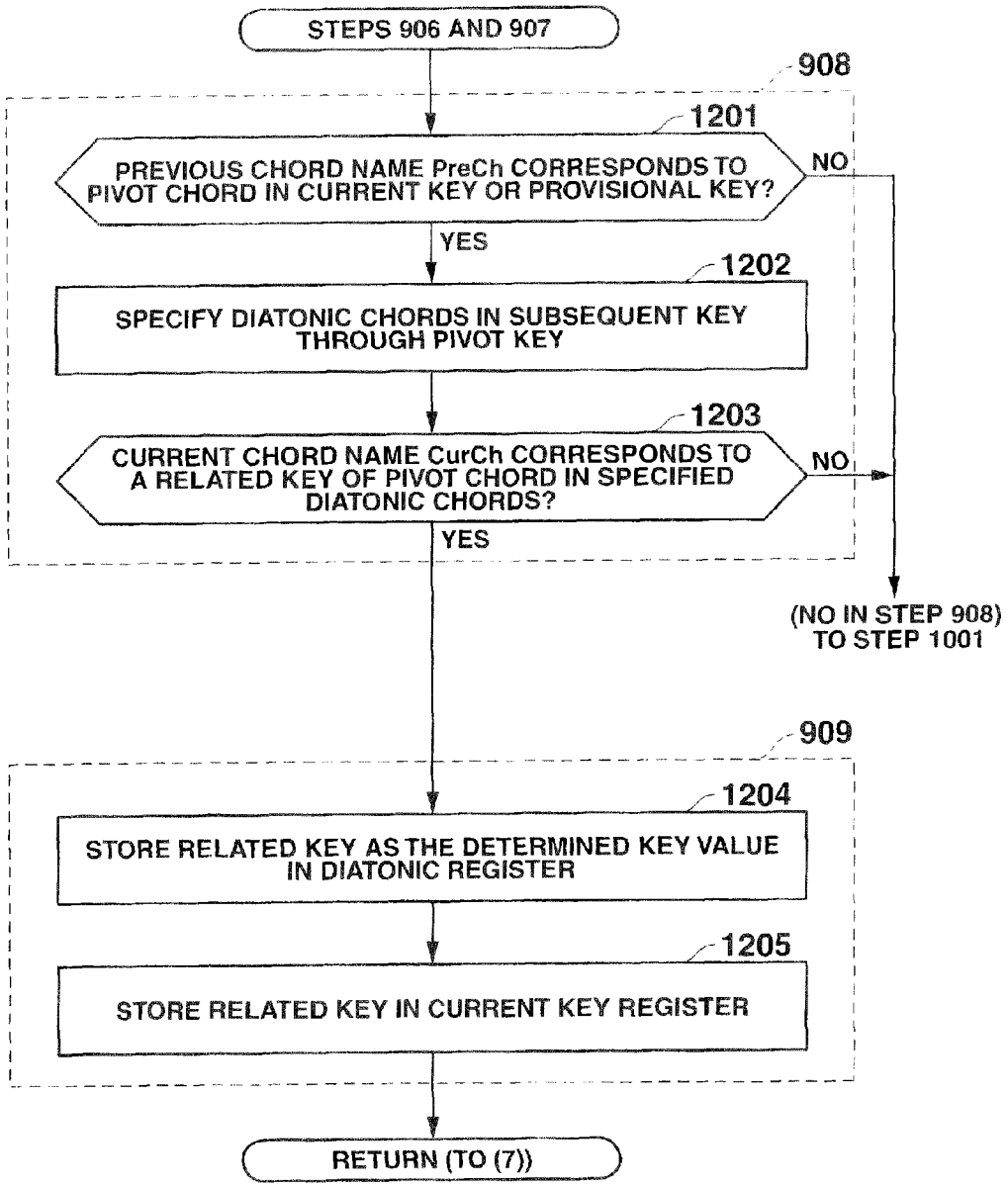
FIG. 12 is a flowchart showing an example of the modulation process to a related key according to the embodiment.

If it is "No" in the step 906, the CPU 21 determines whether the current chord name corresponds to a pivot chord in the pivot modulation (step 908). If it is "Yes" in the step 908, the modulation process to the related key is carried out. FIG. 12 is a flowchart showing examples of the steps 908 and 909 in more detail. In FIG. 12, the steps 1201 to 1203 correspond to the step 908 of FIG. 9, and the steps 1204 to 1205 correspond to the step 909 of FIG. 9.

The CPU 21 determines whether the previous chord name PreCh corresponds to the pivot chord in the current key or provisional key (step 1201). For example, when the current key is C, the diatonic chords thereof are as follows:

CM7 (IM7)
Dm7 (IIm7)
Em7 (IIIm7)
FM7 (IVM7)
G7 (V7)
Am7 (VIm7)
$Bm7^{(-5)}$ ($vIIm7^{(-5)}$)

For example, of these, Em7 corresponds to the diatonic chord (IIm7) in the key of D, the diatonic chord (VIm7) in the key of G, and the like, whereas Am7 corresponds to the diatonic chord (IIm7) in the key of G, and the like.

For example, a table that indicates correspondence between each chord name and a corresponding diatonic chord in each key is stored in the RAM 23. In this way, it suffices only if the CPU 21 determines whether a chord corresponds to a pivot chord only by referring to the table (step 1201). If it is "Yes" in the step 1201, diatonic chords in the subsequent key through the pivot chord is specified (step 1202). Then, the CPU 21 determines whether the current chord name CurCh corresponds to the related key of the pivot chord in the diatonic chords specified in the step 1202 (step 1203). If it is "No" in the step 1201 or in the step 1203 (which corresponds to the case where it is determined as "No" in the step 908), the operation proceeds to the step 1001.

If it is "Yes" in the step 1203, the modulation process to the related key (step 909) is carried out. The CPU 21 stores the related key as the determined key value in the unit register of the diatonic register (step 1204). Further, the CPU 21 stores the related key in the current key register in the RAM 23 as well (step 1205).

If it is "No" in the step 908, the CPU 21 determines whether the current chord name CurCh corresponds to the I or III chord of the key which is a half tone, a whole tone or a minor third higher than the current key or the provisional key (step 1001). If it is "Yes" in the step 1001, the modulation process by a climax is carried out (step 1002). This modulation process by the climax will be explained later.

If it is "No" in the step 1001, the CPU 21 determines a key based on the degree of the chord, and stores it as a determined key value in the diatonic register (step 1003). After that, the operation proceeds to the step 1004, and the CPU 21 stores the determined key in the current key register. Further, the CPU 21 stores the established chord name (step 1005) and clears the modulation flag (step 1006).

Figure 13:
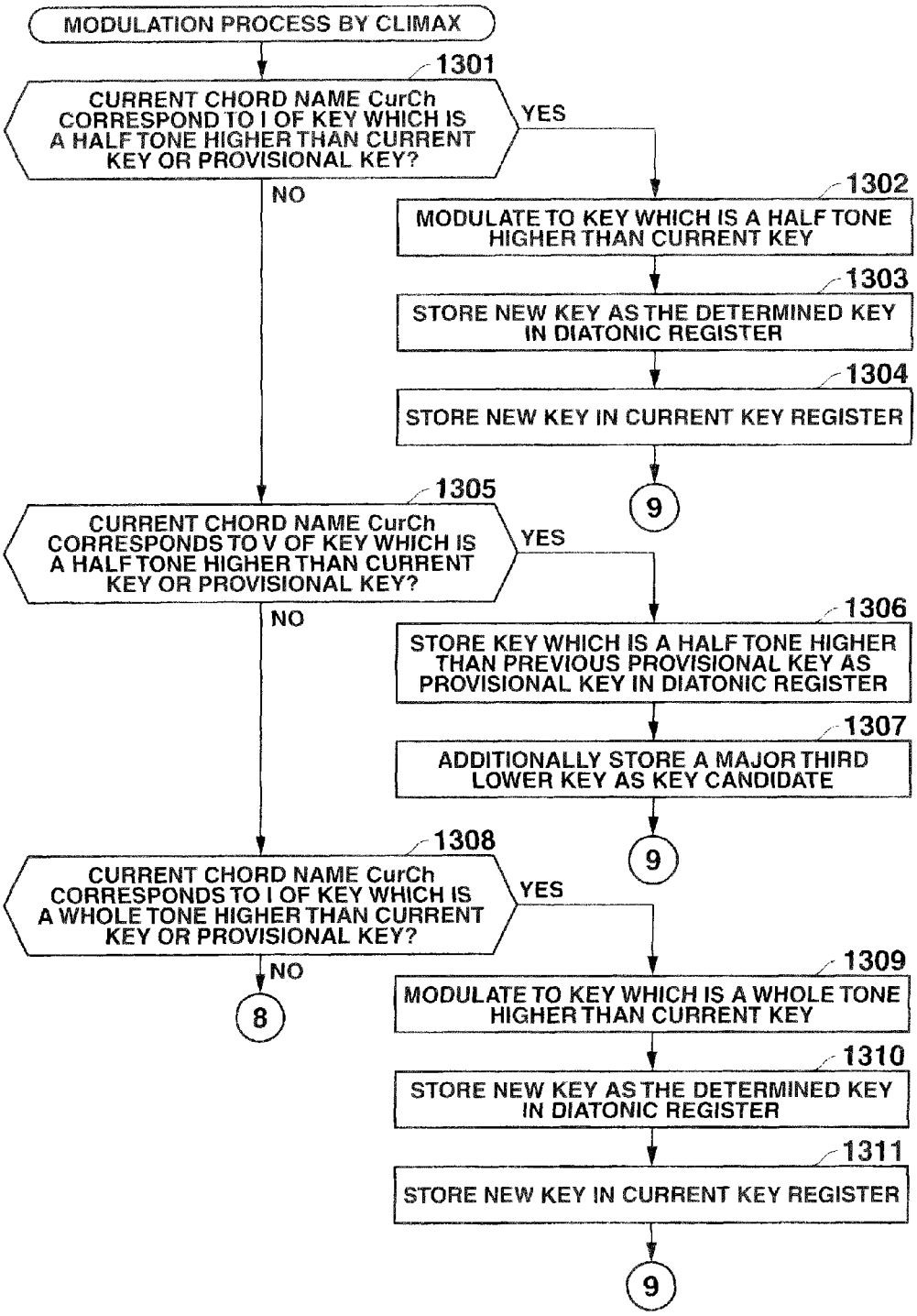
FIG. 13 is a flowchart showing an example of the modulation process by a climax according to the embodiment in the first part.
Figure 14:
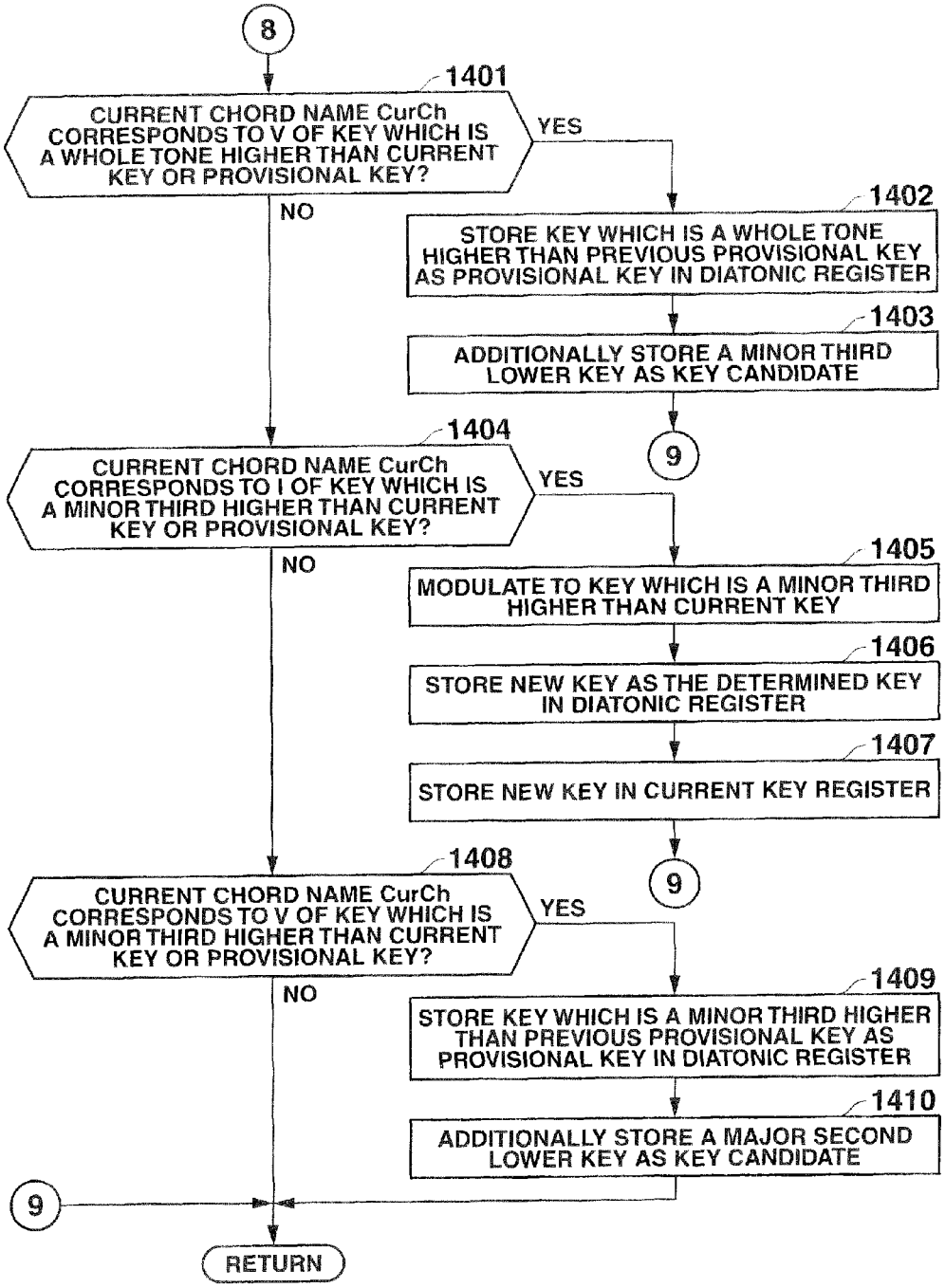
FIG. 14 is a flowchart showing the example of the modulation process by a climax according to the embodiment in the last part.

FIGS. 13 and 14 are flowcharts showing an example of the modulation process by a climax according to the embodiment.

As shown in FIG. 13, the CPU 21 determines whether the current chord name CurCh corresponds to the I chord of the key which is a half tone higher than the current key or the provisional key (step 1301).

If it is "Yes" in the step 1301, the CPU 21 obtains a note name of a key which is a half tone higher than the current key and determines that the music is modulated to the key of this note name (step 1302). The CPU 21 stores the key obtained in the step 1302 as the determined key in the unit register of the diatonic register (step 1302). Further, the CPU 21 stores the key obtained in the step 1302 in the current key register in the RAM 23 (step 1304).

If it is "No" in the step 1301, the CPU 21 determines whether the current chord name CurCh corresponds to the V chord of the key which is a half tone higher than the current key or the provisional key (step 1305). If it is "Yes" in the step 1305, the CPU 21 stores a key which is a half tone higher than the previous provisional key as the provisional key in the unit register of the diatonic register (step 1306). Further, the CPU 21 stores a key which is a major third lower from a key which is a half tone higher from the previous provisional key, as a key candidate in the unit register (step 1307).

If it is "No" in the step 1305, the CPU 21 determines whether the current chord name CurCh corresponds to the I chord of the key which is a whole tone higher than the current key or the provisional key (step 1308). If it is "Yes" in the step 1308, the CPU 21 obtains the note name of a whole tone higher than the current key and determines that the music is modulated to the key of this note name (step 1309). Then, the CPU 21 stores the key obtained in the step 1309 as the determined key in the unit register of the diatonic register (step 1310). Further, the CPU 21 stores the key obtained in the step 1309 in the current key register in the RAM 23 (step 1311).

If it is "No" in the step 1308, the CPU 21 determines whether the current chord name CurCh corresponds to the V chord of the key which is a whole tone higher than the current key or the provisional key (step 1401). If it is "Yes" in the step 1401, the CPU 21 stores a key which is a whole tone higher than the previous provisional key as the provisional key in the unit register of the diatonic register (step 1402). Further, the CPU 21 stores a key which is a minor third lower from a key which is a whole tone higher from the previous provisional key, as a key candidate in the unit register (step 1403).

If it is "No" in the step 1401, the CPU 21 determines whether the current chord name CurCh corresponds to the I chord of the key which is a minor third higher than the current key or the provisional key (step 1404). If it is "Yes" in the step 1404, the CPU 21 obtains a note name of a key which is a minor third higher than the current key and determines that the music is modulated to the key of this note name (step 1405). Then, the CPU 21 stores the key obtained in the step 1405 as the determined key in the unit register of the diatonic register (step 1406). Further, the CPU 21 stores the key obtained in the step 1405 in the current key register in the RAM 23 (step 1407).

If it is "No" in the step 1404, the CPU 21 determines whether the current chord name CurCh corresponds to the V chord of the key which is a minor third higher than the current key or the provisional key (step 1408). If it is "Yes" in the step 1408, the CPU 21 stores a key which is a minor third higher than the previous provisional key as the provisional key in the unit register of the diatonic register (step 1409). Further, the CPU 21 stores a key which is a major second lower from a key which is a whole tone higher from the previous provisional key, as a key candidate in the unit register (step 1410).

Figure 19:
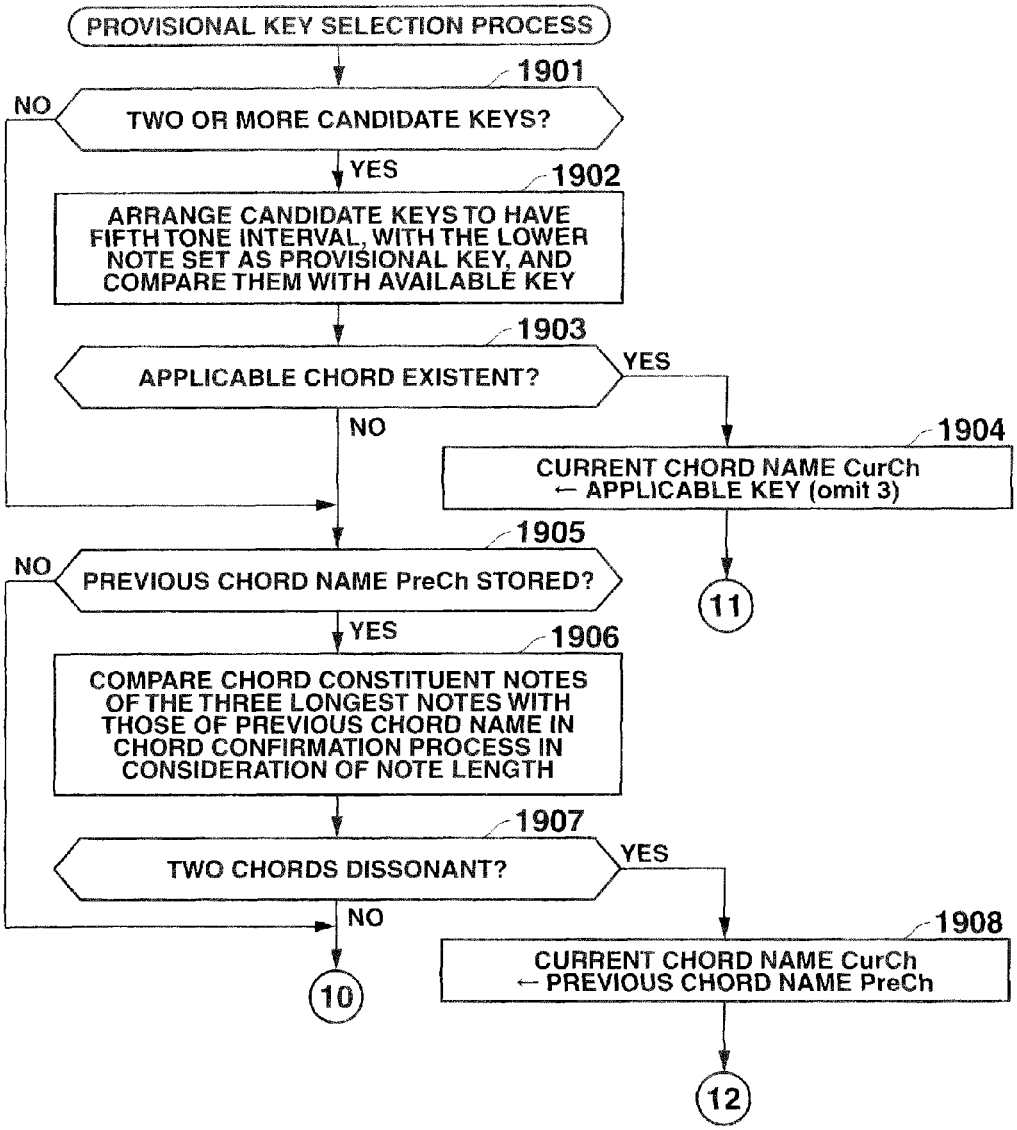
FIG. 19 is a flowchart showing an example of the provisional key selection process according to the embodiment in the first part.
Figure 20:
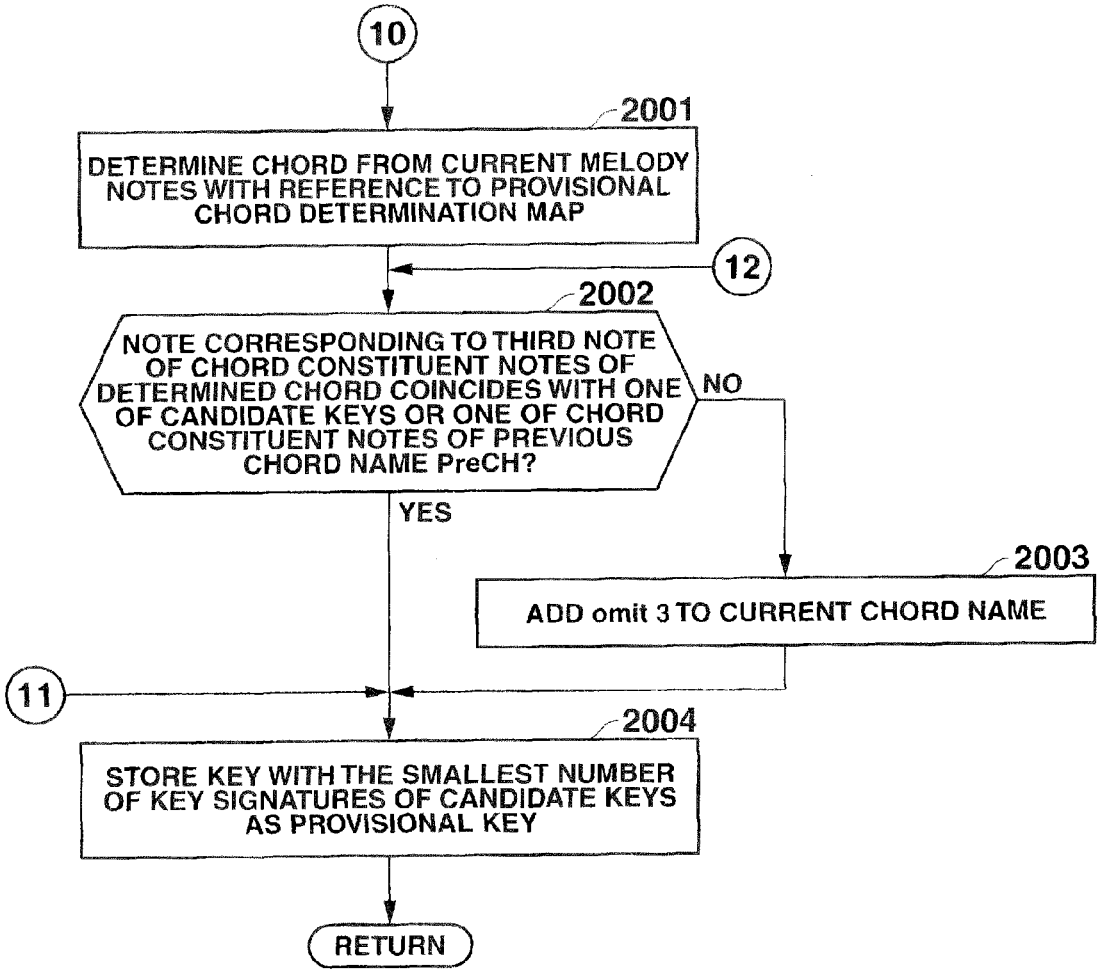
FIG. 20 is a flowchart showing the example of the provisional key selection process according to the embodiment in the last part.

Next, the provisional key selection process (step 902) will now be explained. FIGS. 19 and 20 are flowcharts showing an example of the provisional key selection process according to the embodiment. As shown in FIG. 19, the CPU 21 determines whether there are two or more candidate keys in the unit register of the diatonic register (step 1901). If it is "Yes" in the step 1901, the CPU 21 arranges two of the candidate keys to have a fifth tone interval, with the lower note set as the provisional key, and compares them with the available chord table (step 1902).

In step 1902, a chord in which the two notes having the fifth relationship make chord constituent notes is searched in the available chord table. When such a chord is found, it is determined as "Yes" in the step 1903. In the case where a pair of two notes of the candidate keys which have the fifth relationship are not obtained, it is determined as "No" in the step 1903. If it is "Yes" in the step 1903, the CPU 21 stores, as the current chord name CurCh, the chord name found in the step 1902 with "omit3" indicating that the third note is omitted from the chord (step 1904).

If it is "No" in the step 1903, or it is "No" in the step 1901, the CPU 21 determines whether the previous chord name PreCh is stored in the RAM 23 (step 1905). If it is "Yes" in the step 1905, the CPU 21 compares the chord constituent notes of the three longest notes with the chord constituent notes of the previous chord name PreCh (step 1906), as in the case of the step 804 in the chord confirming process in consideration of the note length (FIG. 8). In the case where the two chords compared are not dissonant ("No" in the step 1907), the previous chord name PreCh is stored as the current chord name CurCh in the RAM 23 (step 1908). When two chords are disharmonious, it means that the tonics of the two chords have a relationship of, for example, minor second, major second, augmented fourth (diminished fifth), minor seventh, or major seventh.

If it is "Yes" in the step 1907, the CPU 21 determines the chord from the current melody notes with reference to the provisional chord determination map in the RAM 23 (step 2001). FIG. 21 is a diagram showing an example of the provisional chord determination map according to the embodiment. As shown in FIG. 21, chord names are respectively assigned to melody notes in the provisional chord determination map. The CPU 21 determines whether the note corresponding to the third note (characterizing note) of the constituent notes of the determined chord coincides with one of the candidate keys in the unit register of the diatonic 25 register or one of the chord constituent notes of the previous chord name PreCh (step 2002). If it is "No" in the step 2002, the CPU 21 add information "omit3" indicating that the third note is omitted from the chord to the current chord name (step 2003).

After that, the CPU 21 stores the key with the smallest number of key signatures of the candidate keys as the provisional key in the unit register of the diatonic register (step 2004). It should be noted that with respect to the note of the first manipulator press, a chord is determined through the provisional key selection process with reference to the provisional chord determination map.

Figure 22:
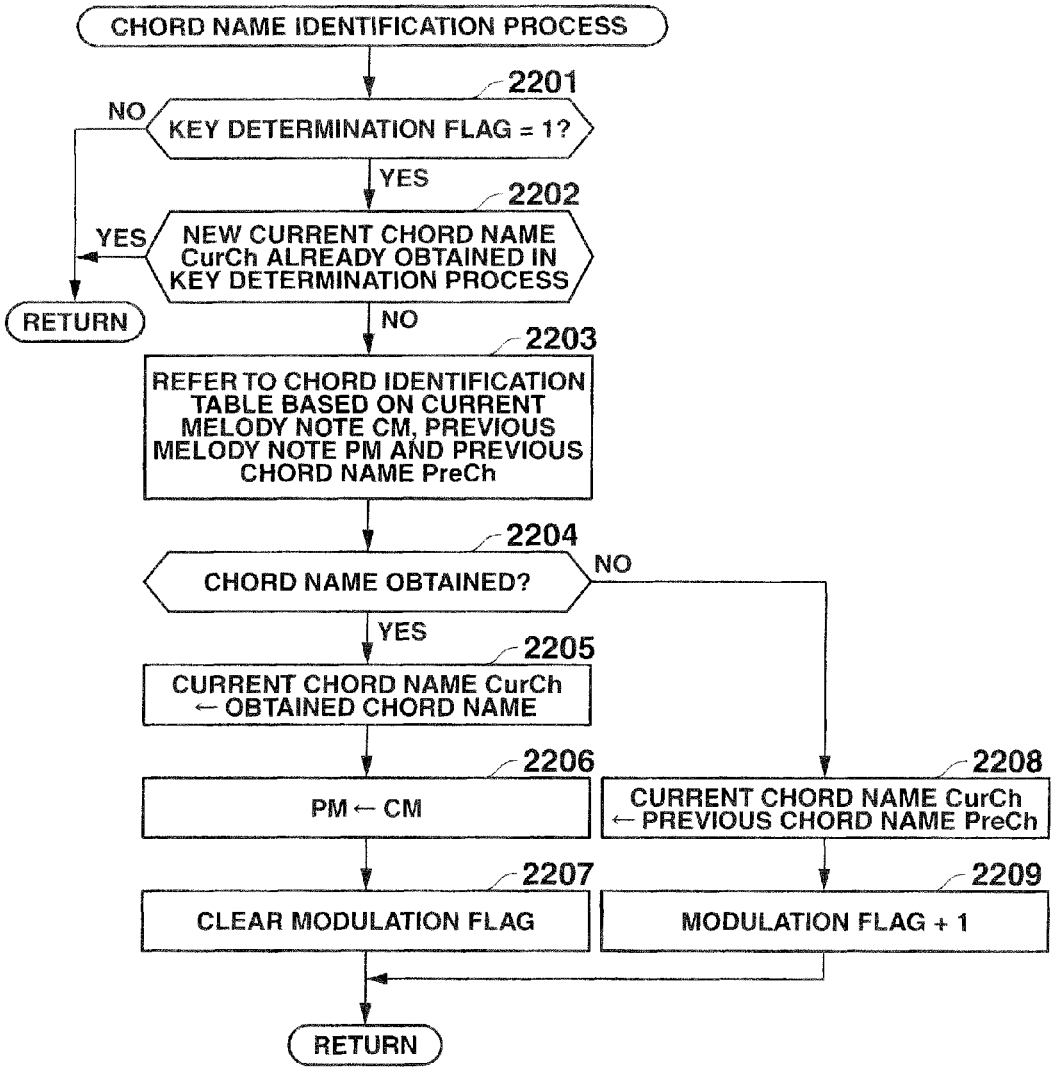
FIG. 22 is a flowchart showing an example of the chord name determination process according to the embodiment.

When the key determination process is finished, the CPU 21 executes the chord name determination process. FIG. 22 is a flowchart showing an example of the chord name determination process according to the embodiment. As shown in FIG. 22, the CPU 21 determines whether the key determination flag in the RAM 23 is "1" (step 2201). If it is "Yes" in the step 2201, the CPU 21 determines whether a new current chord name CurCh is already obtained in the key determination process (step 2202). If it is "No" in the step 2201, or it is "Yes" in the step 2202, the process is finished.

If it is "No" in the step 2202, the chord determination table is referred to obtain the chord name based on the current melody note CM, the previous melody note PM and the previous chord name PreCh (step 2203). It should be noted that the current melody note CM is the name of the manipulator pressed at the top of the current beat in the music currently in progress, and the previous melody note PM is the name of the manipulator pressed at the top of the one previous beat. These notes are obtained based on the information stored in the RAM 23 in the keyboard process (shown in FIG. 4).

FIG. 23 is a diagram showing an example of the chord determination table according to the embodiment. In the chord determination table shown in FIG. 23, the chord name is obtained based on the combination of the function of the previous chord name (one of tonic (TO), subdominant (SU) and dominant (DO)), the previous melody note and the current melody note. It should be noted that the chord determination table 2300 is for the case of key "C".

Therefore, in the case of some other key, the musical interval (step) between the tonic of the key and C is regarded as the offset. Then, in consideration of the offset from the actual previous melody note and the actual current melody note, the previous melody note and the current melody note in the case where the key is set to C are calculated to be used. Although it is not shown in the example of FIG. 23, there are a few cases in which the chord name cannot be obtained depending on the combination of a previous melody note and a current melody note.

The CPU 21 determines whether the chord name has been obtained with reference to the chord determination table (step 2204). If it is "Yes" in the step 2204, the CPU 21 stores the chord name obtained in the step 2203 as the current chord name CurCh in the RAM 23 (step 2205). Further, the CPU 21 stores in the RAM 23 the current melody note CM as the previous melody note PM (step 2206) and clears the modulation flag (step 2207).

If it is "No" in the step 2204, the CPU 21 stores the previous chord name PreCh as the current chord name CurCh in the RAM 23 (step 2208). Further, the CPU 21 increments the modulation flag in the RAM 23 (step 2209). The modulation flag indicates the number of times in which the current chord name is not determined. When the number of times becomes larger than a predetermined threshold (see step 504 in FIG. 5), the above-mentioned modulation process is executed (see step 508 in FIG. 5).

Figure 24:
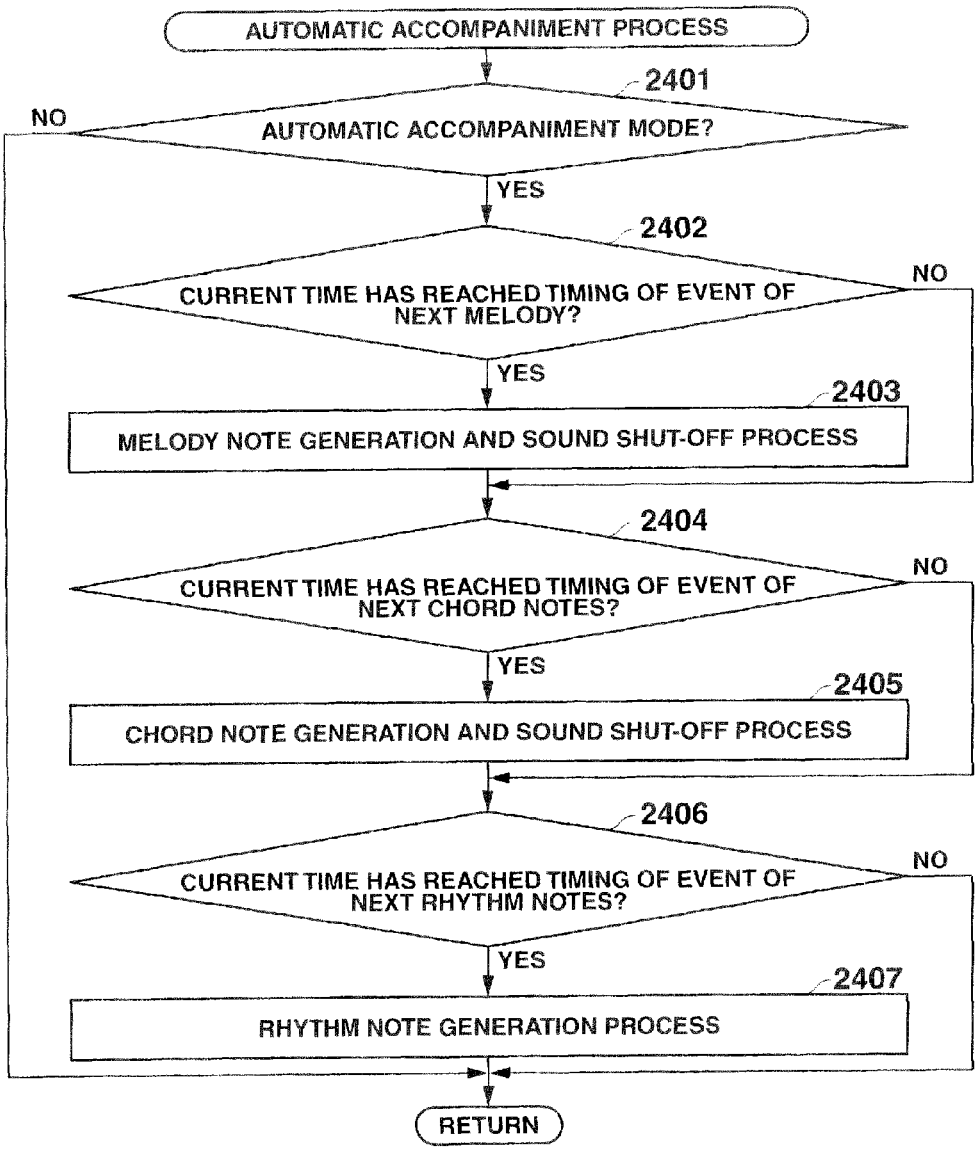
FIG. 24 is a flowchart showing an example of the automatic accompaniment process according to the embodiment.

When the chord name determination process (step 305) is finished, the CPU 21 executes the automatic accompaniment process (step 306). FIG. 24 is a flowchart showing an example of the automatic accompaniment process according to the embodiment. First, the CPU 21 determines whether the electronic instrument 10 is operating in the automatic accompaniment mode (step 2401). If it is "Yes" in the step 2201, the CPU 21 determines with reference to the time (not shown) whether the current time has reached the execution timing of the event for the data of the melody notes in the automatic accompaniment data (step 2402).

The automatic accompaniment data includes data of three types of musical notes, namely, melody notes (including obligate notes), chord notes and rhythm notes. The data of the melody notes and the data of the chord notes include a sound generation timing and a sound generation time period for each musical note to be to be generated. On the other hand, the data of the rhythm notes include a sound generation timing for each musical note (rhythm note) to be to be generated.

If it is "Yes" in the step 2402, the CPU 21 executes the melody note generation and sound shut-off process (step 2403). In the melody note generation and sound shut-off process, it is determined whether an event to be processed is Note-On. It is determined as the event of Note-On if the current time substantially coincides with the sound generation timing of a predetermined musical note in the data of the melody notes. On the other hand, it is determined as the event of Note-Off if the current time substantially coincides with the time obtained by adding the sound generation time period to the sound generation timing of the musical note.

In the case where it is determined an event to be processed is Note-Off, the CPU executes the sound shut-off process. On the other hand, in the case where it is determined an event to be processed is Note-On, the CPU executes the sound generation process in accordance with the data of the melody note.

Next, the CPU 21 determines with reference to the timer (not shown) of the CPU 21 whether the current time has reached the execution timing of the event for the data of the chord notes in the automatic accompaniment data (step 2404). If it is "Yes" in the step 2404, the CPU 21 executes the chord note generation and sound shut-off process (step 2405). In the chord note generation and sound shut-off process, the sound generation process is executed for the chord notes which have reached the sound generation timing. On the other hand, the sound shut-off process is executed for the chord notes which have reached the sound shut-off timing.

After that, the CPU 21 determines whether the current time has reached the execution timing of the event for the data of the rhythm notes in the automatic accompaniment data (step 2406). If it is "Yes" in the step 2406, the CPU 21 executes the rhythm note generation process (step 2407). In the rhythm note generation process, the event of Note-On is generated for the rhythm note which has reached the sound generation timing.

When the automatic accompaniment process (the step 306 in FIG. 3) is finished, the CPU 21 executes the sound source sound generation process (step 307). In the sound source sound generation process, the CPU 21 supplies the data indicating the tone color and pitch of the note to be generated to the sound source unit 26 based on the generated event of Note-On, or supplies the data indicating the tone color and pitch of the note to be shut off to the sound source unit 26. The sound source unit 26 reads out waveform data items of the ROM 22 in accordance with the data indicating the tone color, sound pitch, note length, etc, and generates a predetermined musical note data. In this manner, the determined musical note is output from the speaker 28. Further, in the case of the event of Note-Off, the CPU 21 instructs the sound source 26 to shut off the note pitch indicated by the event of Note-Off.

When the sound source sound generation process (step 307) is finished, the CPU 21 executes other processes (for example, the image display on the display unit 15, turning on or off of the LED [not shown]) (step 308), and then the operation returns to the step 302.

In this embodiment, the CPU 21 compares the note names in a melody note history and the diatonic scale table in the unit register of the diatonic register, so as to determine whether there is a key in which all of the note names in the melody note history are included in the diatonic scale of the key. In this manner, the key candidates are narrowed down, the key of the musical composition is determined, and the determined key is stored in the unit register. Therefore, simply by the melody sequence only, it is possible to determine the key of musical notes.

Further, in this embodiment, a plurality of key candidates are still present even after narrowing down of the key candidates, the CPU 21 determines whether the key notes in a melody note history contain a tritone in the diatonic scale of each of the key candidates and the scale notes within the tritone. In this manner, the key candidates are further narrowed down. By considering not only whether melody notes are simply traced on the diatonic scale of a key, but also the tritone specific to each key, it becomes possible to determine the key more precisely.

Further, in this embodiment, a plurality of key candidates are still present even after narrowing down of the key candidates, the CPU 21 determines that the key with the smallest number of key signatures is the key of the composition. In this manner, when there are a plurality of key candidates, it becomes possible to select a key with a higher probability.

Further, in this embodiment, the CPU 21 compares the note names in a melody note history in the unit register of the diatonic register and the key scale note table which stores a tritone specific to each key and the scale notes within the tritone in the diatonic scale notes for each key, so as to determine whether the note names in the melody note history contain a tritone specific to a key and the scale notes within the tritone. In this manner, the key candidates are narrowed down, the key of the musical composition operated by the player is determined, and the determined key is stored in the register.

Therefore, according to this embodiment, by considering a tritone specific to a key and the scale notes within the tritone, it is possible to determine the key accurately.

Furthermore, in this embodiment, when the key candidates are narrowed down to one, the CPU 21 stores the one key candidate in the unit register as the determined key. In the other case, the CPU 21 stores one of the key candidates in the unit register as the provisional key. With this structure, the information on the key can be stored in accordance with the certainty of the determined key.

Moreover, the CPU 21 determines the current chord name based on the sound pitch associated with the manipulator pressed (for example, the current sound pitch and the preceding sound pitch) and the previous chord name which is the preceding chord name. In the case where there is predetermined relation with regard to the key stored in the register, the CPU 21 obtains the new key based on predetermined relationship. In this manner, even in the case where a modulation occurs in the middle of a musical composition being played, the modulated key can be appropriately determined.

According to this embodiment, in the case where the current chord name corresponds to a 7-th chord having a relationship other than III7 or V7 with respect to the key stored in the register, the CPU 21 calculates the differential value between the current key and the fundamental note of the current chord name, and also add to the current key the above-mentioned differential value and five half tones, thereby obtaining the new key. In this manner, the modulation by the dominant motion can be detected.

Further, according to this embodiment, in the case where the previous chord name corresponds to a pivot chord in the key stored in the register, and the current chord name corresponds to the related key of the pivot chord in the diatonic chords of the subsequent key through the pivot chord, the related key is obtained as the new key. In this manner, the so-called pivot modulation can be detected.

Furthermore, according to this embodiment, in the case where the current chord name corresponds to a I or III chord of the key which is a half tone, a whole tone or a minor third higher than the key stored in the register, the CPU 21 obtains each of the half tone higher key, the whole tone key higher and the minor third higher key as the new key. In this manner, the modulation due to the so-called climax can be detected.

The present invention is not limited to the above-described embodiment, but can be modified into various versions within the scope of the inventions recited in the claims. Naturally, these modified versions are encompassed within the scope of the present invention.

For example, when determining a key, either a major key or a minor key which corresponds to the parallel key of the major key may be determined. In this case, it suffices only if a selection switch which selects major key or minor key is provided, and in the switching process, the CPU 21 determines the manipulation state of the selection switch and stores the selection information indicative of major key or minor key selected in advance and stored in the RAM 23. In the key determination process, it suffices if the CPU 21, when obtaining a provisional key or a determined key, determines whether the obtained key is a major key or a minor key with reference to the selection information indicative of major key or minor key selected in advance and stored in the RAM 23, and stores the determined key (major key or minor key) in the diatonic register or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A key determination apparatus comprising:

a manipulator information obtaining unit configured to obtain at least a melody note corresponding to a manipulator manipulated;

a storage device including (a) a register configured to store at least (i) a melody note history of melody notes corresponding to manipulators manipulated and (ii) key candidates, based on information obtained by the manipulator information obtaining unit, and (b) a first table configured to store diatonic scale notes for each of the key candidates; and a key determination unit configured to compare the melody note history with the diatonic scale notes for each of the key candidates and determine whether there is a key candidate in which all of the melody notes in the melody note history coincide with any of the diatonic scale notes of the key candidate, thereby determining a key of a musical composition played by the manipulation of the manipulators, and storing the determined key in the register.

2. The key determination apparatus according to claim 1, wherein when there are a plurality of key candidates in which all of the melody notes in the melody note history coincide with any of the diatonic scale notes of each of the plurality of key candidates, the key determination unit determines whether the melody notes in the melody note history contain (i) a tritone and (ii) scale notes between the tritone of the diatonic scale notes of each of the key candidates, thereby further narrowing down the key candidates.

3. The key determination apparatus according to claim 1, wherein when there are a plurality of key candidates in which all of the melody notes in the melody note history coincide with any of the diatonic scale notes of each of the plurality of key candidates, the key determination unit determines a key with a smallest number of key signatures as the key of the musical composition.

4. The key determination apparatus according to claim 1, wherein:

the storage device further includes (c) a second table configured to store (i) a tritone specific to each key candidate and (ii) scale notes between the tritone of the diatonic scale notes for each of the key candidates, and the key determination unit compares the melody note history with the second table and determines whether there is a key candidate in which the melody notes in the melody note history contain a tritone of the key candidate and scale notes between the tritone, thereby determining the key of a musical composition played by the manipulation of the manipulators, and storing the determined key in the register.

5. The key determination apparatus according to claim 1, wherein when the key determination unit narrows down the key candidates to one, the one key candidate is stored in the register as a determined key, and in other cases, one of the key candidates is stored in the register as a provisional key.

6. The key determination apparatus according to claim 1, further comprising a chord name determination unit configured to determine a current chord name based on the melody note corresponding to the manipulator manipulated and a previous chord name which is a preceding chord name, and wherein when the current chord name has a predetermined relationship with regard to the key stored in the register, the key determination unit obtains a new key based on the predetermined relationship.

7. The key determination apparatus according to claim 6, wherein when the current chord name corresponds to a 7-th chord having relationship other than I117 or V7 with regard to the key stored in the register, the key determination unit calculates a differential value between the key and a fundamental note of the current chord name, and obtains a new key by adding the differential value and 5 half tones to the key.

8. The key determination apparatus according to claim 6, wherein when the previous chord name corresponds to a pivot chord in the key stored in the register, and the current chord name corresponds to a related key of the pivot chord in diatonic chords of a subsequent key through the pivot chord, the key determination unit obtains the related key as a new key.

9. The key determination apparatus according to claim 6, wherein when the current chord name corresponds to a I or III chord of the key which is a half tone, a whole tone or a minor third higher than the key stored in the register, the key determination unit obtains the half tone, whole tone or minor third higher key as the new key.

10. The key determination apparatus, according to claim 1, wherein the key determination unit determines whether the obtained key is a major key or a minor key with reference to selection information indicative of major key or minor key selected in advance and stored in the storage device.

11. A key determination apparatus comprising:

a manipulator information obtaining unit configured to obtain at least a melody note corresponding to a manipulator manipulated;

a storage device including:

(a) a register configured to store at least (i) a melody note history of melody notes corresponding to manipulators manipulated, and (ii) key candidates, based on information obtained by the manipulator information obtaining unit, and (b) a table configured to store (i) a tritone specific to each key candidate and (ii) scale notes between the tritone of diatonic scale notes for each of the key candidates; and a key determination unit configured to compare the melody note history with the table and determine whether there is a key candidate in which the melody notes in the melody note history contain a tritone of the key candidate and scale notes between the tritone, thereby determining a key of a musical composition played by the manipulation of the manipulators, and storing the determined key in the register.

12. A non-transitory computer-readable storage medium having program code stored thereon for performing key determination that is executable by a computer comprising a storage device including (a) a register configured to store at least (i) a melody note history of melody notes corresponding to manipulators manipulated, and (ii) key candidates, and (b) a table configured to store diatonic scale notes for each of the key candidates, the program code being executable by the computer to perform functions comprising:

executing a manipulator information obtaining process of obtaining at least a melody note corresponding to a manipulator manipulated and storing obtained information in the register; and executing a key determination process of comparing the melody note history with the diatonic scale notes for each of the key candidates and determining whether there is a key candidate in which all of the melody notes in the melody note history coincide with any of the diatonic scale notes of the key candidate, thereby determining a key of a musical composition played by the manipulation of the manipulators, and storing the determined key in the register.

13. A non-transitory computer-readable storage medium having program code stored thereon for performing key determination that is executable by a computer comprising a storage device including (a) a register configured to store at least (i) a melody note history of melody notes corresponding to manipulators manipulated, and (ii) key candidates, and (b) a table configured to store (i) a tritone specific to each key candidate and (ii) scale notes between the tritone of diatonic scale notes for each of the key candidates, the program code being executable by the computer to perform functions comprising:

executing a manipulator information obtaining process of obtaining at least a melody note corresponding to a manipulator manipulated and storing obtained information in the register; and executing a key determination process of comparing the melody note history with the table and determining whether there is a key candidate in which the melody notes in the melody note history contain a tritone of the key candidate and scale notes between the tritone, thereby determining a key of a musical composition played by the manipulation of the manipulators, and storing the determined key in the register.

* * * * *